US008299382B2

(12) United States Patent
Takemae et al.

(10) Patent No.: US 8,299,382 B2
(45) Date of Patent: Oct. 30, 2012

(54) KEY SWITCH AND KEYBOARD

(75) Inventors: Akihiko Takemae, Shinagawa (JP); Shuji Nakamura, Shinagawa (JP); Tamotsu Koike, Shinagawa (JP); Takeshi Nishino, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 790 days.

(21) Appl. No.: 12/232,608

(22) Filed: Sep. 19, 2008

(65) Prior Publication Data

US 2009/0078552 A1 Mar. 26, 2009

(30) Foreign Application Priority Data

Sep. 20, 2007 (JP) ..... 2007-244230

(51) Int. Cl.
*H01H 13/70* (2006.01)

(52) U.S. Cl. ..... 200/344; 200/341

(58) Field of Classification Search ..... 200/341–345, 200/5 A, 517; 400/490, 491, 491.1, 491.2, 400/495, 495.1, 496
See application file for complete search history.

(56) References Cited

U.S. PATENT DOCUMENTS

| | | | | |
|---|---|---|---|---|
| 5,657,860 | A | 8/1997 | Koike et al. | |
| 5,813,521 | A * | 9/1998 | Koike et al. | 200/344 |
| 6,455,794 | B2 * | 9/2002 | Sato et al. | 200/344 |
| 6,812,421 | B2 * | 11/2004 | Sato et al. | 200/344 |
| 6,906,272 | B1 | 6/2005 | Tsai | |
| 2007/0158172 | A1 | 7/2007 | Yatsu et al. | |

FOREIGN PATENT DOCUMENTS

| | | | |
|---|---|---|---|
| CN | 2155200 | Y | 2/1994 |
| CN | 1716483 | A | 1/2006 |
| JP | 09-190735 | | 7/1997 |
| JP | 2001-229764 | | 8/2001 |
| TW | 493775 | | 7/2002 |

OTHER PUBLICATIONS

JP 2001-229764 (Reference AG) was cited in the European Search Report (Reference BE) dated Jan. 20, 2010 in corresponding European Patent Application 08164695.2.
European Search Report dated Jan. 20, 2010 and issued in corresponding European Patent Application 08164695.2.
Office Action mailed form the Taiwanese Patent Office on Nov. 1, 2011 in the corresponding Taiwanese patent application No. 097134222.

* cited by examiner

*Primary Examiner* — Amy Cohen Johnson
*Assistant Examiner* — Marina Fishman
(74) *Attorney, Agent, or Firm* — Staas & Halsey LLP

(57) ABSTRACT

A key switch including a base section, a key top, a pair of link members and a switching mechanism. Each link member is provided, at one end region thereof, with a toothed portion meshable with a toothed portion of another link member in a gearing manner and a pivot axle pivotably joined to the base section, and at another end region, with a slide portion slidably engaged with the key top. The base section includes a support plate and a frame member, the frame member being fixedly attached to the upper surface of the support plate. The frame member is provided with a bearing portion pivotably receiving and supporting the pivot axle of each link member. The first end region of each link member is disposed on a lateral side of the frame member and closely to the upper surface of the support plate.

14 Claims, 18 Drawing Sheets

KEY SWITCH AND KEYBOARD

BACKGROUND OF THE INVENTION

1. Field of the Invention

The present invention relates generally to a switch configuration for a keying operation, and more particularly to a key-entry switch device (hereinafter referred to as a key switch) preferably used for a keyboard incorporated as an input device in electronic equipment. The present invention also relates to a keyboard provided with a plurality of key switches.

2. Description of the Related Art

In a thinner or low-profile type keyboard, used in a portable electronic apparatus such as a notebook or palm-top personal computer, it is necessary to reduce the height of a key switch for a keying operation as well as to improve the operability and structural reliability of the key switch. The key switch usable in the low-profile keyboard typically includes a base section, a key top disposed above the base section, a pair of link members interlocked to each other to support and direct the key top in a vertical or upward-and-downward direction relative to the base section, and a switching mechanism capable of opening and closing a contact section of an electronic circuit in accordance with a vertical or upward-and-downward movement of the key top. The key top is movable substantially vertically relative to the base section, through an interlocking action of the link members, while maintaining a predetermined posture of the key top.

In the above key switch, a device configuration generally referred to as a gear-link-type, wherein a pair of link members are meshed in a gearing manner at one-end regions thereof with each other and thus assembled together in an interlockable manner, is known (see, e.g., Japanese Unexamined Patent Publication (Kokai) No. 9-190735 (JP-A-9-190735)). A switching mechanism configured from the combination of a sheet-like switch including a pair of flexible circuit boards respectively carrying contacts, constituting a contact section of an electric circuit, in a mutually facing arrangement (referred to as a membrane switch sheet, in this application), and an actuating member disposed between the key top and the membrane switch sheet and acting to close the contacts in accordance with the descending or downward motion of the key top, has also been widely used.

JP-A-9-190735 discloses two different configurations of a gear-link-type key switch, one of which includes a pair of link members showing an inverted V-shape as seen from a lateral direction (or in a side view) when a key top is located at the upper limit position of a vertical movement (hereinafter referred to as an inverted V-shaped gear link), and the other of which includes a pair of link members showing a V-shape as seen from a lateral direction (or in a side view) when a key top is located at the upper limit position of a vertical movement (hereinafter referred to as a V-shaped gear link). In the inverted V-shaped gear link, each link member is provided, at one end region thereof, with a tooth or teeth constituting a meshing mechanism and a pivot axle pivotably joined to a bearing portion formed in the key top and, at the opposite other end region thereof, with a slide portion slidably engaged with a guide portion formed in the base section. In the V-shaped gear link, each link member is provided, at one end region thereof, with a tooth or teeth constituting a meshing mechanism and a pivot axle pivotably joined to a bearing portion formed in the base section and, at the opposite other end region thereof, with a slide portion slidably engaged with a guide portion formed in the key top. In either configuration, during a vertical movement of the key top, the pair of link members rotate about the pivot axles in a mutually interlocking manner through the meshing mechanism, and respective slide portions of the link members move substantially in a horizontal direction under the guiding action of the guide portion of the base section or key top. In the key switch described in JP-A-9-190735, a base section is constituted by a support plate disposed under a membrane switch sheet and a housing disposed above the membrane switch sheet, and the guide portion or the bearing portion is formed on the upper surface of the housing.

In the key switch described in JP-A-9-190735, due to the configuration in which the guide portion or the bearing portion for receiving the slide portion or the pivot axle of the link member is formed on the upper surface of the housing disposed above the membrane switch sheet, the thickness of the housing is included in the dimension of the key switch in a height direction. In recent years, in order to meet the requirement of thinning of a keyboard in which key switches are installed, it is necessary to reduce the height of a key switch without impairing the operability thereof, and from this viewpoint, it is desirable to reduce, as far as possible, the dimension of a component, which may influence the height dimension of the key switch or, if possible, to eliminate such a component.

In a key switch having an inverted V-shape gear link configuration, bearing portions for pivotally support the pivot axles of link members are formed at positions near the center of the inner surface of a key top, so that, when, for example, external force is applied to the outer edge of the key top so as to pull the key top apart from the base section, the force acting to separate the bearing portion from the pivot axle of the link member tends to be increased due to leverage. As a result, the pivot axle may be disengaged from the bearing portion, and thereby the key top may be disassembled from the link member.

In contrast, in a key switch having a V-shaped gear link configuration, guide portions for receiving the slide portions of link members are formed at locations near the outer edge of the inner surface of a key top, so that there is an advantage that, for example, when external force is applied to the outer edge of the key top so as to pull the key top apart from the base section, the force acting to separate the guide portion from the slide portion of the link member is not significantly increased. However, as described above, the presence of the housing may hamper further reduction in height of the key switch. In addition, due to the configuration wherein, during the vertical movement of the key top, the slide portion of each link member is moved along the corresponding guide portion of the key top, a clearance formed between the slide portion and the guide portion may cause displacement or fluctuation of the key top in a direction intersecting a vertical movement direction.

SUMMARY OF THE INVENTION

It is an object of the present invention to provide a key switch having a V-shaped gear link configuration, which can effectively reduce the overall height dimension of the key switch.

It is another object of the present invention to provide a key switch having a V-shaped gear link configuration, which can prevent a key top from being shifted in a direction intersecting a vertical movement direction, during the vertical movement of the key top.

It is a further object of the present invention to provide a low-profile keyboard including a plurality of key switches, which exhibits excellent operability and structural reliability.

To accomplish the above object, the present invention provides a key switch comprising a base section; a key top disposed above the base section; a pair of link members interlocked with each other to support and direct the key top in a vertical direction relative to the base section; and a switching mechanism capable of opening and closing a contact section of an electronic circuit in accordance with a vertical movement of the key top; wherein each of the pair of link members is provided, at one end region thereof, with a toothed portion meshable with a toothed portion of another link member in a gearing manner and a pivot axle pivotably joined to the base section and, at another end region of each link member, with a slide portion slidably engaged with the key top; wherein the base section comprises a support plate provided with an upper surface adjacent to the switching mechanism, and a frame member fixedly attached to the upper surface of the support plate, the frame member being provided with a bearing portion pivotably receiving and supporting the pivot axle of each of the pair of link members; and wherein the one end region of each of the pair of link members is disposed on a lateral side of the frame member and closely to the upper surface of the support plate.

The above configuration includes a pair of link members having a V-shaped gear link configuration and thus, even when, for example, an external force is applied to the outer edge of the key top so as to pull the key top apart from the base section, the force acting to separate the key top from the slide portion of the link member is not significantly increased, and the disengagement of the key top from the link member is substantially eliminated. Further, in the configuration wherein one end region of each link member is disposed on the lateral side of the frame member and closely to the upper surface of the support plate, the dimension of the frame member does not affect the height dimension of the key switch, and the pivot axle of each link member is inserted into the bearing portion of the frame member from the lateral side thereof so as to permit the smooth rotation of the pivot axle. As a result, the inventive key switch can effectively reduce the overall height dimension thereof without impairing the operability, and thus can meet the requirement of the height reduction of a keyboard into which the key switch is installed.

In the above key switch, the bearing portion of the frame member may be formed as a cutout defined between the frame member and the upper surface of the support plate.

The switching mechanism may include a membrane switch sheet disposed on the upper surface of the support plate and carrying the contact section at a position beneath the key top; the membrane switch sheet may be provided with a through-hole at an area at least corresponding to the bearing portion of the frame member; and each of the pair of link members may extend, at the one end region including the pivot axle, through the through-hole of the membrane switch sheet and placed on the upper surface of the support plate.

The frame member may be provided with a leg projecting outward; the support plate may be provided with a reception hole for receiving the leg; and the frame member may be fixed to the support plate by the leg penetrating through the reception hole and deformed along a lower surface of the support plate.

The pair of link members may be disposed in their entirety along the lateral side of the frame member, when the key top is located at a lower limit position of the vertical movement.

The key switch may further comprise abutment portions provided on the key top and each of the pair of link members, the abutment portions being slidingly abutted to each other during a time when the key top performs the vertical movement and preventing the key top from shifting relative to the pair of link members in a direction intersecting the vertical direction.

The present invention also provides a keyboard comprising an array of a plurality of key switches, each key switch being defined above.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
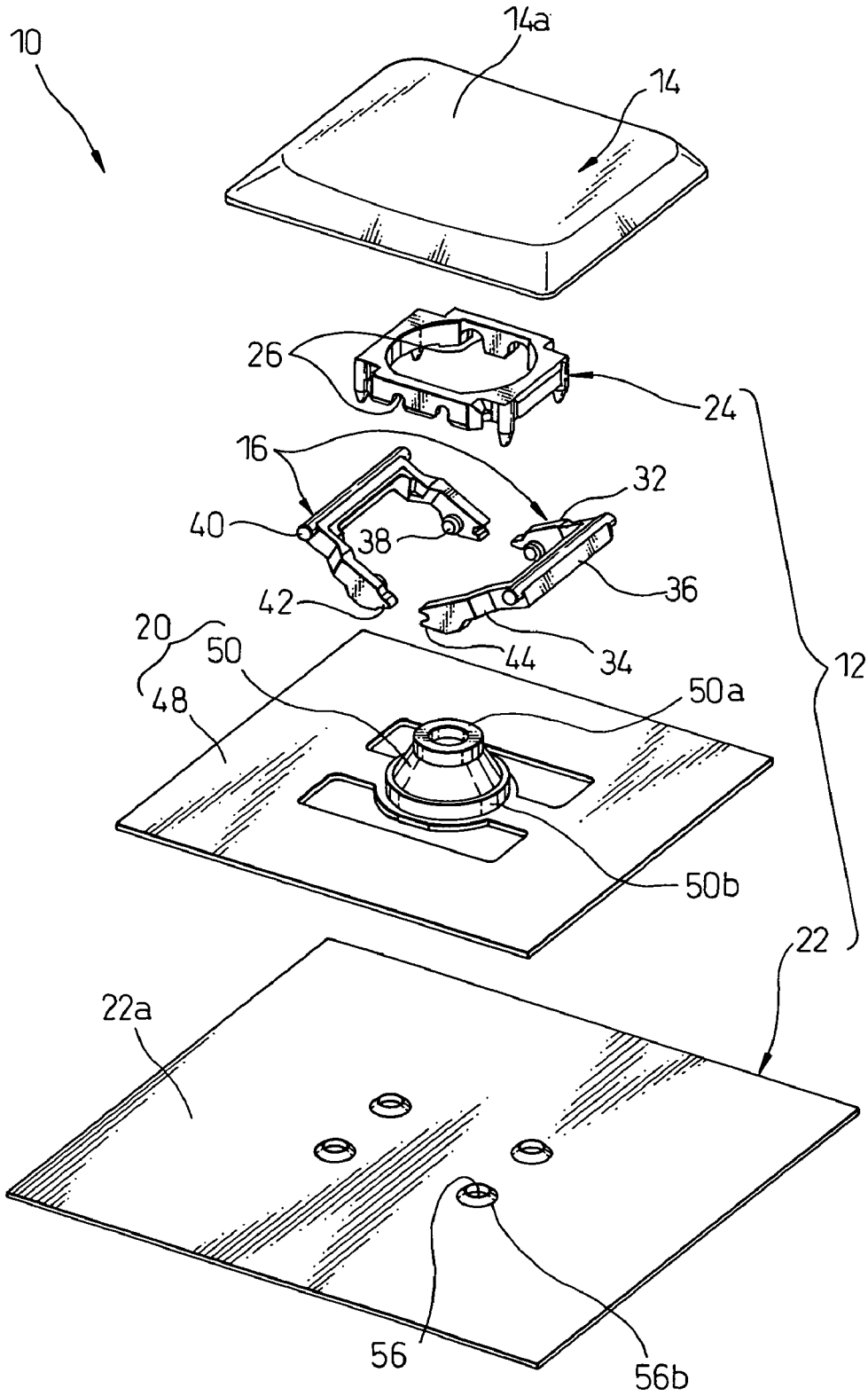
FIG. 1 is an exploded perspective view showing a key switch according to an embodiment of the present invention.

The embodiments of the present invention are described below in detail, with reference to the accompanying drawings. In the drawings, same or similar components are denoted by common reference numerals.

Figure 2:
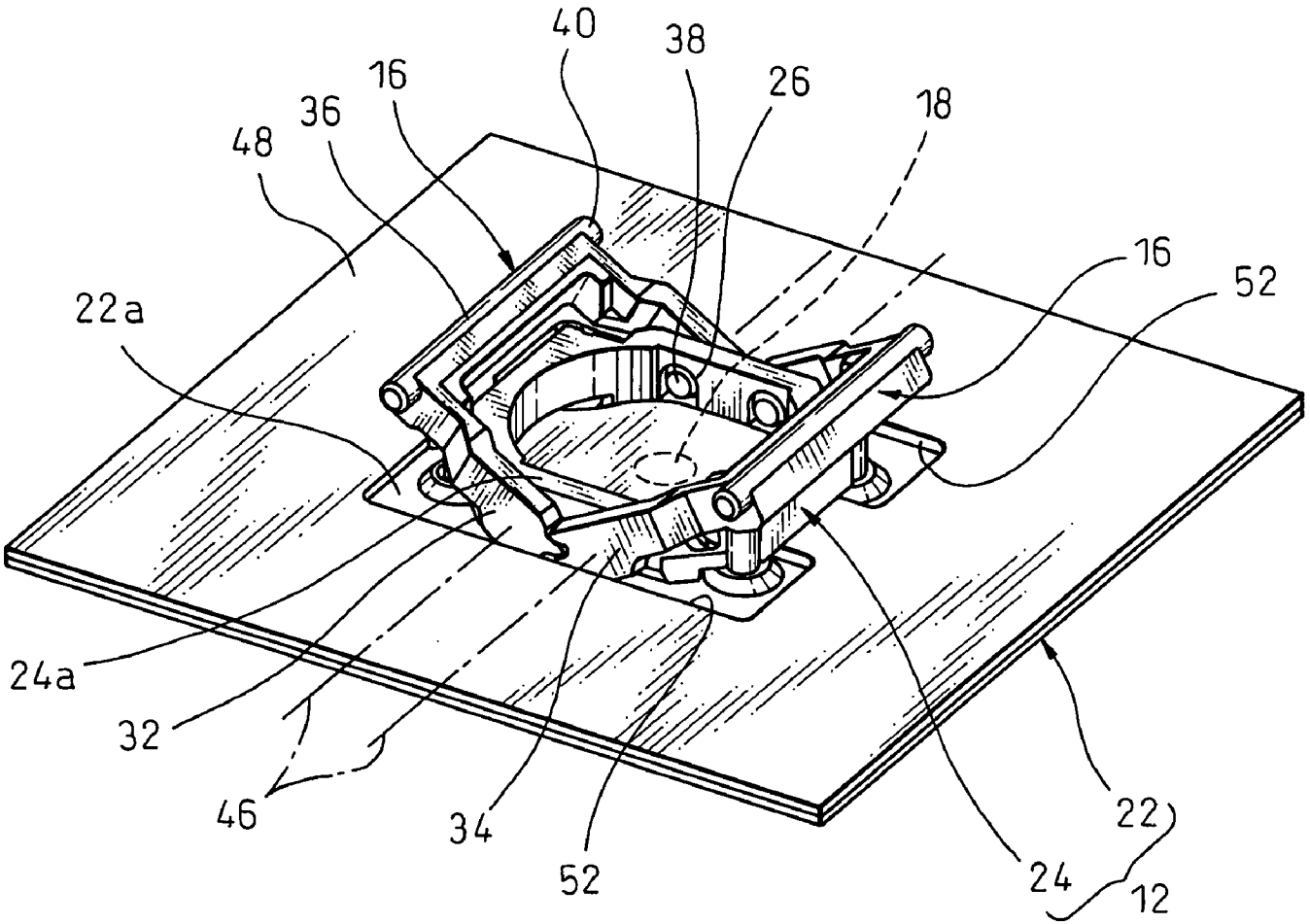
FIG. 2 is a perspective view showing the essential parts of the key switch of FIG. 1 in an assembled state.
Figure 3:
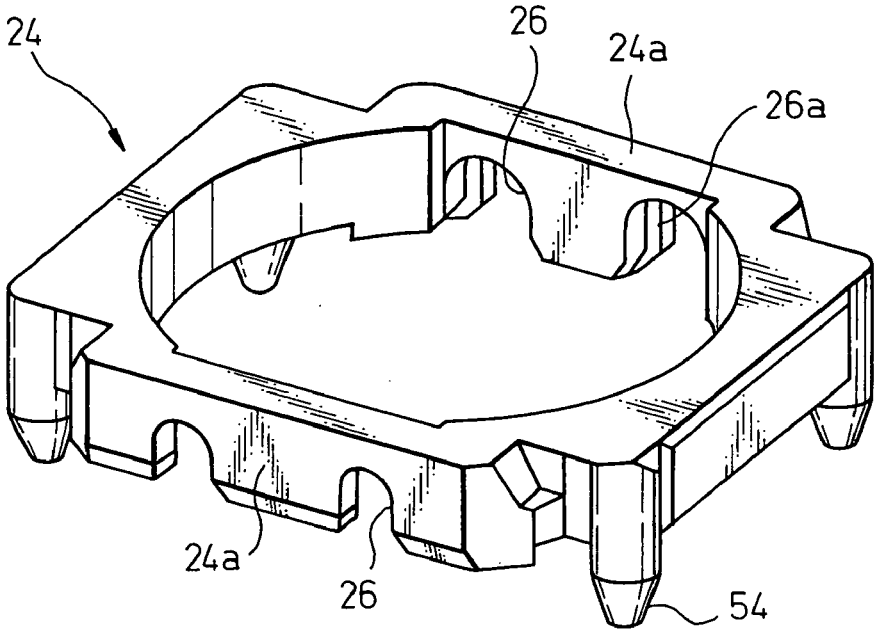
FIG. 3 is an enlarged perspective view showing a frame member used in the key switch of FIG. 1.
Figure 4:
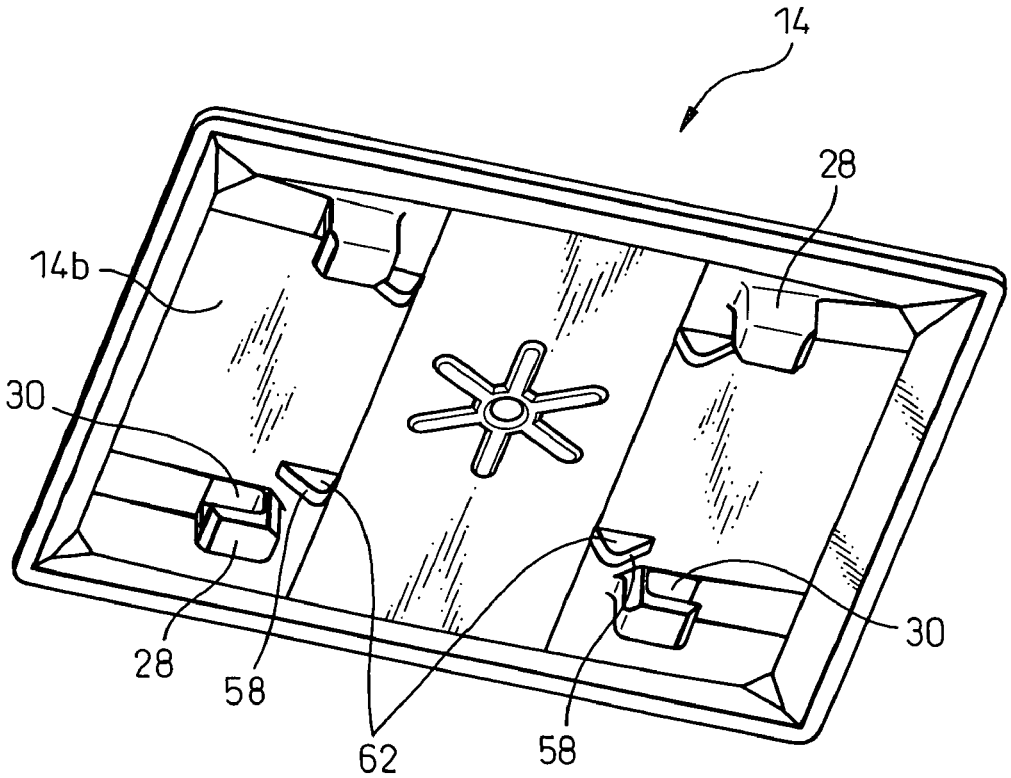
FIG. 4 is an enlarged perspective view showing a key top used in the key switch of FIG. 1 as seen from a bottom side.
Figure 5:
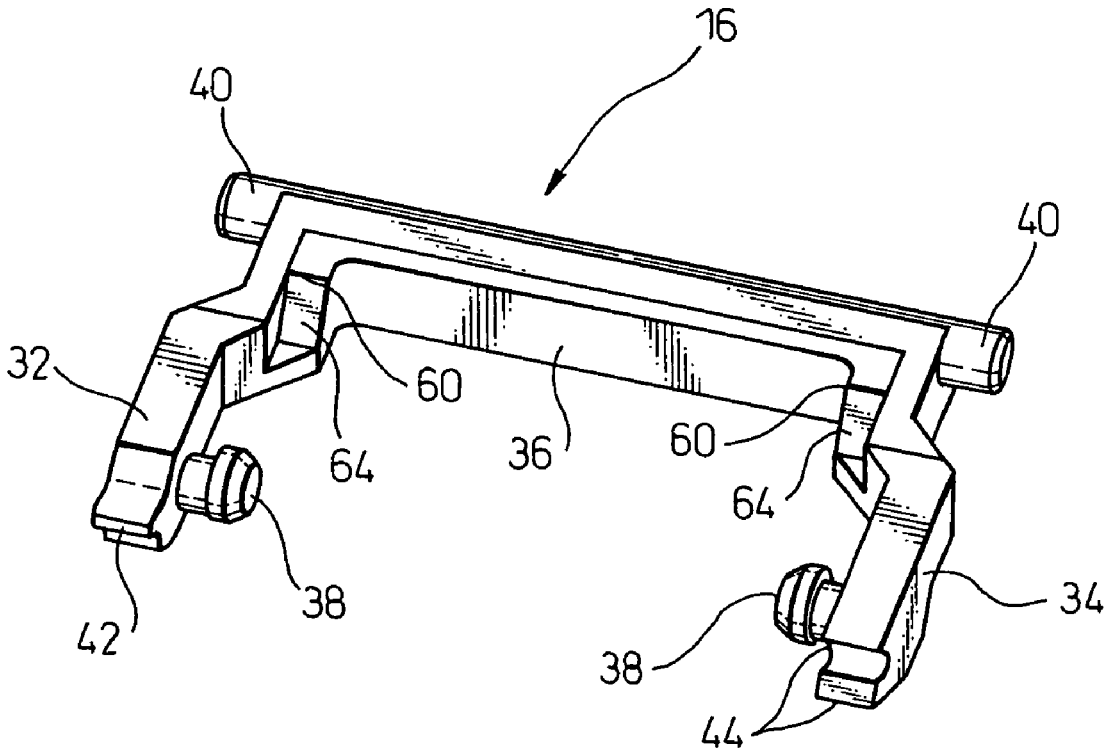
FIG. 5 is an enlarged perspective view showing a link member used in the key switch of FIG. 1.
Figure 6:
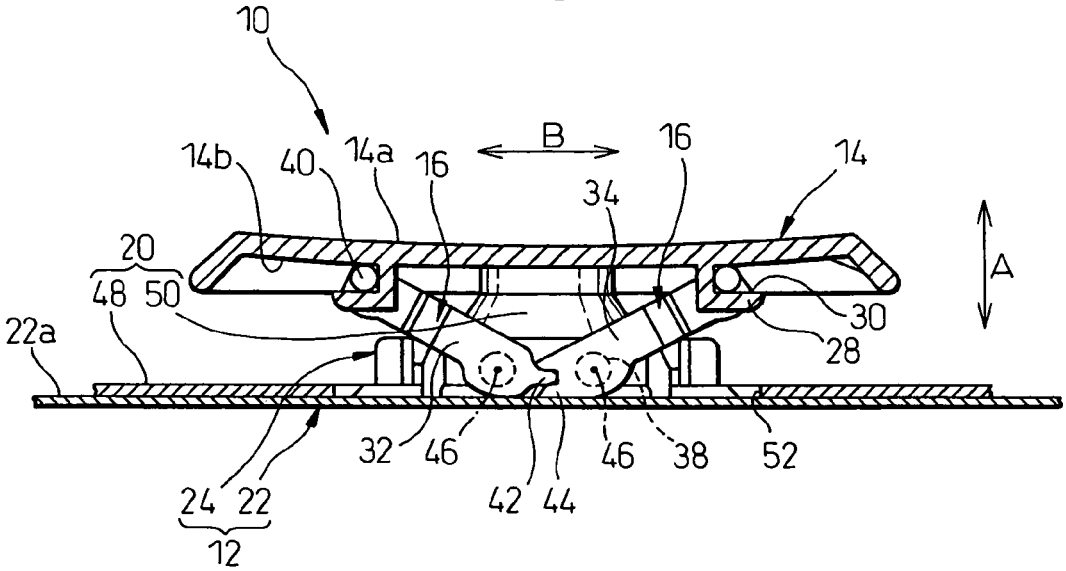
FIG. 6 is a sectional view showing the key switch of FIG. 1 in an assembled state at an inoperative position.

Referring to the drawings, FIG. 1 shows, in an exploded perspective view, a key switch 10 according to an embodiment of the present invention; FIG. 2 shows, in an assembled perspective view, the essential parts of the key switch 10; FIGS. 3 to 5 shows, in enlarged perspective views, several components of the key switch 10; and FIG. 6 shows, in an assembled sectional view, the key switch 10 at an inoperative position. The key switch 10 can be advantageously applied to a thinner or low-profile type keyboard equipped for a portable electronic apparatus such as a notebook or palm-top personal computer.

As shown in FIGS. 1 and 2, a key switch 10 includes a base section 12, a key top 14 disposed above the base section 12, a pair of link members 16 interlocked with each other, the link members 16 supporting the key top 14 above the base section 12 and directing the key top 14 in a vertical or upward-and-downward direction relative to the base section 12, and a switching mechanism 20 capable of opening and closing a contact section of an electronic circuit in accordance with a vertical or upward-and-downward movement of the key top 14. The key top 14 can be upwardly and downwardly moved substantially vertically relative to the base section 12, through the interlocking action of the link members 16, while keeping a predetermined posture of the key top 14.

The base section 12 includes a rigid and flat support plate 22 functioning as a structural base of the key switch 10, such as a separate metallic shin-plate made of a sheet metal material or a resinous bottom panel of a keyboard into which the key switch 10 is incorporated. The support plate 22 is provided with a generally flat upper surface 22*a* adjacent to the switching mechanism 20.

The base section 12 further includes a frame member 24 fixedly attached to the upper surface 22*a* of the support plate 22, as a characteristic component of the key switch 10. The frame member 24 is a frame-like component having a generally rectangular profile as seen in a plan view and, e.g., integrally molded into a unitary member from a resinous material, and is provided, in a pair of frame parts 24*a* constituting two opposing sides of the rectangular profile, with bearing portions 26 for pivotably receiving and supporting pivot axles of each link member 16 as described later (FIG. 3). In the illustrated embodiment, two sets of bearing portions 26 are formed in the pair of frame parts 24*a* in such a manner as to penetrate therethrough and open in a lateral direction so as to communicate the inside and outside of the frame member. The bearing portions 26 in each frame part 24*a* are disposed close to each other as seen in a link sliding direction as described later (i.e., a leftward-and-rightward direction in FIG. 6). Each of the pair of link members 16 is pivotably joined, at the pivot axles (as described later) provided in one end region (i.e., a first end region) of the link member, to the two bearing portions 26 constituting each set. Further detail of the frame member 24 will be described later.

The key top 14 is a dish-like component having a generally rectangular shape as seen in a plan view and, e.g., integrally molded into a unitary member from a resinous material, and includes an operation surface 14*a* subjected to a keying operation by an operator and an inner surface 14*b* opposite to the operation surface 14*a*. The key top 14 is provided, on the inner surface 14*b*, with guide portions 28 for slidably engaging with slide portions of each link member 16 as described later (FIG. 4). In the illustrated embodiment, two sets of guide portions 28 are formed at locations near the four corners of outer periphery of the key top 14 in such a manner as to project, like a wall, from the inner surface 14*b*. Each guide portion 28 includes a guide groove 30 extending generally parallel to the inner surface 14*a* of the key top 14. Two guide portions 28 constituting each set are spaced apart from each other by a distance permitting the other end region (i.e., a second end region) of each link member 16 to be inserted therebetween, and the slide portions (as described later) provided in the second end region of the link member 16 are slidably engaged with the guide grooves 30 of the guide portions 28.

A pair of link members 16 have shapes and dimensions identical to each other, and are meshed in a gearing manner at one-end regions thereof with each other and thus assembled together in an interlockable manner. The link members 16 have a V-shaped gear link configuration showing a V-shape as seen in a side view when the key top 14 is located at the upper limit position of the vertical movement. Each link member 16 is, for example, integrally molded into a unitary member from a resinous material, and includes a pair of arms 32, 34 extending in a direction identical to and generally parallel to each other, and a trunk 36 interconnecting the arms 32, 34 with each other, as shown in FIG. 5. In the illustrated embodiment, in each of the link members 16, a region involving the distal end and its vicinity of the arms 32, 34, at a location away from the trunk 36, is defined as one end (i.e., a first end) region of the link member 16, and an opposite region involving the proximal end and its vicinity of the arms 32, 34, at a location adjacent to the trunk 36, is defined as the other end (i.e., a second end) region of the link member 16.

In the first end region of each link member 16, a pair of generally cylindrical pivot axles 38 are provided to project coaxially with each other from the opposing inner sides of the arms 32, 34 and parallel to the trunk 36. In the second end region of each link member 16, a pair of generally cylindrical slide portions 40 are provided to project coaxially with each other from the mutually facing-away outer sides of the arms 32, 34 and oppositely to the trunk 36. Further, on one arm 32 of each link member 16, one tooth 42 is provided on the distal end surface of the first end region proximal to the pivot axle 38, and on the other arm 34, two teeth 44 are provided on the distal end surface of the first end region proximal to the pivot axle 38.

Each link member 16 is disposed between the base section 12 and the key top 14 in such a manner that the pair of pivot axles 38 in the first end region are pivotably fitted into the corresponding bearing portions 26 provided in the frame member 24 of the base section 12 and the pair of slide portions 40 in the second end region are slidably fitted into the corresponding guide portions 28 (or the guide grooves 30) provided on the key top 14. The pair of link members 16 are configured to form an interlocking structure in which one tooth 42 of the respective one arm 32 is meshed with two teeth 44 of the respective other arm 34, and thereby can rotate in a mutually interlocking manner about respective pivoting axes 46 (FIG. 2) defined by the pivot axles 38 of the arms 32, 34.

Thus, when the link members 16 synchronously rotate in opposite directions about respective pivoting axes 46 (i.e., about the respective rotatable engagement points between the pivot axles 38 and the bearing portions 26) and the respective second end regions slide in a generally horizontal direction under the guiding action of the corresponding guide portions 28 (i.e., under the sliding engagement between the slide portions 40 and the guide grooves 30), the key top 14 is subjected to a parallel displacement in a generally vertical direction A (FIG. 6) relative to the base section 12, while maintaining a predetermined, generally horizontal posture of the key top 14 in which the operation surface 14*a* is substantially parallel to the upper surface 22*a* of the support plate 22 of the base section 12. The upper limit position of the keying stroke (i.e., the stroke of the vertical movement) of the key top 14 is determined when the sliding movement of the second end regions of the link members 16 toward each other is blocked by the surrounding walls of the guide grooves 30 of the corresponding guide portions 28 of the key top 14 (FIG. 6). As the key top 14 descends from the upper limit position, the second end regions of the link members 16 slide, under the guiding action of the guide grooves 30 on the slide portions 40, away from each other in a direction B (FIG. 6) generally orthogonal to the direction of vertical movement of the key top 14. When the key top 14 reaches the lower limit position of the keying stroke, the contact section 18 of the switching mechanism 20 is closed as described later.

The switching mechanism 20 includes a membrane switch sheet 48 carrying the contact section 18 at a position beneath the key top 14 and placed on the upper surface 22*a* of the support plate 22, and an actuating member 50 disposed between the key top 14 and the membrane switch sheet 48 and acting to close the contact section 18 in accordance with the descending or downward motion of the key top 14 (FIG. 1). The membrane switch sheet 48 includes, although not shown, a pair of flexible circuit boards respectively carrying a pair of contacts to face to each other, and a sheet-like spacer supporting the circuit boards with a predetermined gap defined therebetween to maintain the contacts in an opened state. The contacts are patterned on the surfaces of film substrates of the circuit boards and constitute the contact section 18 of the switching mechanism 20 (FIG. 2).

The actuating member 50 is a dome-shaped member integrally molded into a unitary piece from a rubber material, and is disposed between the key top 14 and the membrane switch sheet 48 with the dome top 50*a* facing toward the key top 14. The actuating member 50 is disposed inside the frame member 24 of the base section 12 and fixed to the membrane switch sheet 48, at the bottom dome-open end 50*b* of the actuating member. When no load is applied to the actuating member 50, the dome top 50*a* of the actuating member 50 is upwardly spaced from the membrane switch sheet 48. On the inner surface of the dome top 50*a* of the actuating member 50, a protrusion (not shown) is formed to be aligned with the contact section 18 of the membrane switch sheet 48, for pressing and closing the contact section 18 when the key top 14 is depressed.

In the key switch 10, when no external force is applied to the key top 14, the actuating member 50 urges or biases the key top 14 toward and supports it, by the dome top 50*a*, at the upper limit position of the stroke vertically above and apart from the base section 12 (FIG. 6). At this time, the contact section 18 of the membrane switch sheet 48 is in an opened state. When the key top 14 is depressed by a keying operation, the actuating member 50 is elastically deformed in response to the downward movement of the key top 14, while exerting an elastic biasing force (or an initial-position recovering force) to the key top 14 in an upward direction, and presses by the inside protrusion of the dome top 50*a* the membrane switch sheet 48 from outside thereof, at the instant when the key top 14 reaches the lower limit position of the stroke, so as to close the contact section 18. When the depressing force on the key top 14 is released, the actuating member 50 is elastically restored so as to return the key top 14 to the upper limit position, and thereby the membrane switch sheet 48 is restored to open the contact section 18. Thus, the actuating member 50 also functions as a biasing member exerting elastic biasing force to return the key top 14 toward the upper limit position of the vertical movement.

When the key top 14 is depressed by a keying operation, the actuating member 50 is elastically deformed in a buckling mode due to the dome shape thereof, so that an elastic biasing force is exerted to the key top 14, which assumes non-linear relationship with a displacement of the key top 14. As a result, the key switch 10 can establish unique keying operation properties, accompanied by a so-called click feeling, such that when the amount of depression of the key top 14 exceeds a predetermined value, the biasing force in a return direction, which has been gradually increased until that time, is abruptly reduced.

In the key switch 10 as described above, the bearing portions 26 of the base section 12, for pivotally support the pivot axles 38 of each link member 16, are formed in the pair of frame parts 24*a* of the frame member 24 so as to penetrate therethrough and open in a lateral direction. Thereby, the first end regions of the pair of link members 16 are respectively disposed on the lateral sides of the frame member 24 and closely to the upper surface 22*a* of the support plate 22, while the respective pivot axles 38 are inserted into the corresponding bearing portions 26 from the lateral sides of the frame member 24. In this state, the pivoting axis 46 of each link member 16 is disposed parallel to the upper surface 22*a* of the support plate 22. In this connection, the configuration in which the first end regions are disposed "closely to the upper surface 22*a* of the support plate 22" involves a configuration in which the first end regions of the link members 16 are in contact with the upper surface 22*a* of the support plate 22, as well as a configuration in which the first end regions of the link members 16 are disposed apart from the upper surface 22*a* at locations lower than the height of the frame member 24.

In the key switch 10, as described above, including a pair of link members 16 having the V-shaped gear link configuration, the guide portions 28 for receiving the slide portions 40 of the link members 16 are formed at locations near the outer edges of the inner surface 14*b* of the key top 14 (FIG. 6). Therefore, even when, for example, an external force is applied to the outer edge of the key top 14 so as to pull the key top 14 apart from the base section 12, the force acting to separate the guide portion 28 from the slide portion 40 of the link member 16 is not significantly increased, and thus the disengagement of the slide portion 40 from the guide portion 28, which may lead to the disassembly of the key top 14 from the link member 16, is advantageously eliminated substantially. Further, in the configuration of the key switch 10 wherein the first end region of each link member 16 is disposed on the lateral side of the frame member 24 and closely to the upper surface 22*a* of the support plate 22, the dimension of the frame member 24 does not influence the height dimension of the key switch 10. In this connection, the frame member 24 having the frame-like shape is disposed so as not to interfere with the proper arrangement of the link members 16 and actuating member 50, which may influence the operability of the keying operation of the key switch 10, and thus the pivot axle 38 of each link member 16 is inserted into the bearing portion 26 of the frame member 24 from the lateral side thereof so as to permit the smooth rotation of the pivot axle 38. As a result, the key switch 10 can effectively reduce the overall height dimension thereof without impairing the operability, and thus can meet the requirement of the height reduction of a keyboard into which the key switch 10 is installed.

The key stitch 10 may be variously embodied. For example, it is advantageous that the key switch 10 is configured such that, when the key top 14 is located at the lower limit position of the vertical movement, the pair of link members 16 are disposed in their entirety along the lateral side of the frame member 24. In this configuration, the height dimension of the key switch 10, when the key top 14 is located at the lower limit position of the vertical movement, can be effectively reduced, and the stroke of the keying operation of the key top 14 can be ensured to a maximum extent. In this connection, it is desirable that when the key top 14 is at the lower limit position of the vertical movement, the height of the frame member 24 defined above the support plate 22 is not greater than the overall height of each link member 16 defined above the support plate 22.

Figure 7:
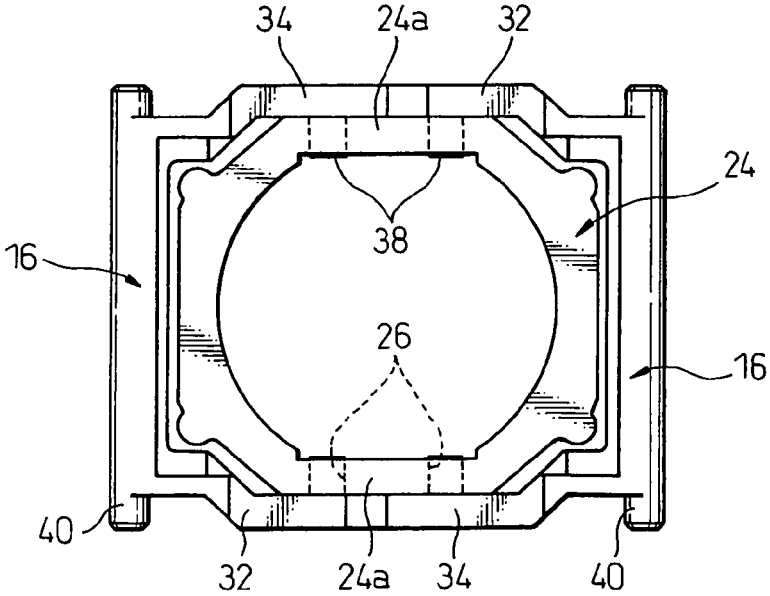
FIG. 7 is a plan view diagrammatically showing a part of the key switch of FIG. 1.

In particular, in the illustrated embodiment, each link member 16 is configured such that, when the key top is at the lower limit position of the vertical movement, the frame member 24 is disposed inside the pair of arms 32, 34 of the link members 16 (FIG. 7). In this configuration, increase in the lateral dimension of the key switch 10 can also be suppressed.

In the key switch 10, the membrane switch sheet 48 may be provided with a through-hole 52 at an area at least corresponding to the bearing portion 26 of the frame member 24. In the illustrated embodiment, at areas corresponding to the pair of frame parts 24*a* of the frame member 24 and certain limited areas surrounding them, through-holes 52 having partially or generally rectangular profile are respectively formed. Each link member 16 extends, at the first end region of the arms 32, 34 with pivot axles 38, through the respective through-holes 52 of the membrane switch sheet 48 and placed on the upper surface 22*a* of the support plate 22 (FIGS. 2 and 6). Each link member 16 is thus configured such that, over the entire stroke of the vertical movement of the key top 14, the first end region of the arms 32, 34 substantially contacts with the upper surface 22*a* of the support plate 22 through the through-holes 52 of the membrane switch sheet 48. In this configuration, the membrane switch sheet 48 is not interposed between the support plate 22 of the base section 12 and the first end region of each link member 16, so that the height dimension of the key switch 10 can be effectively reduced.

In the illustrated embodiment, the frame member 24 extends through the through-holes 52 of the membrane switch sheet 48 and is fixed to the support plate 22. In this configuration, it is not need to provide any separate opening in the membrane switch sheet 48 for fixing the frame member 24 to the support plate 22, and thereby the fabrication of the membrane switch sheet 48 can be simplified. In particular, as shown in FIG. 2, when the membrane switch sheet 48 is not interposed between the support plate 22 and the frame parts 24*a* of the frame member 24 involving fixing portions to the support plate 22, it is possible to securely and stably fix the frame member 24 to the support plate 22.

Figure 8:
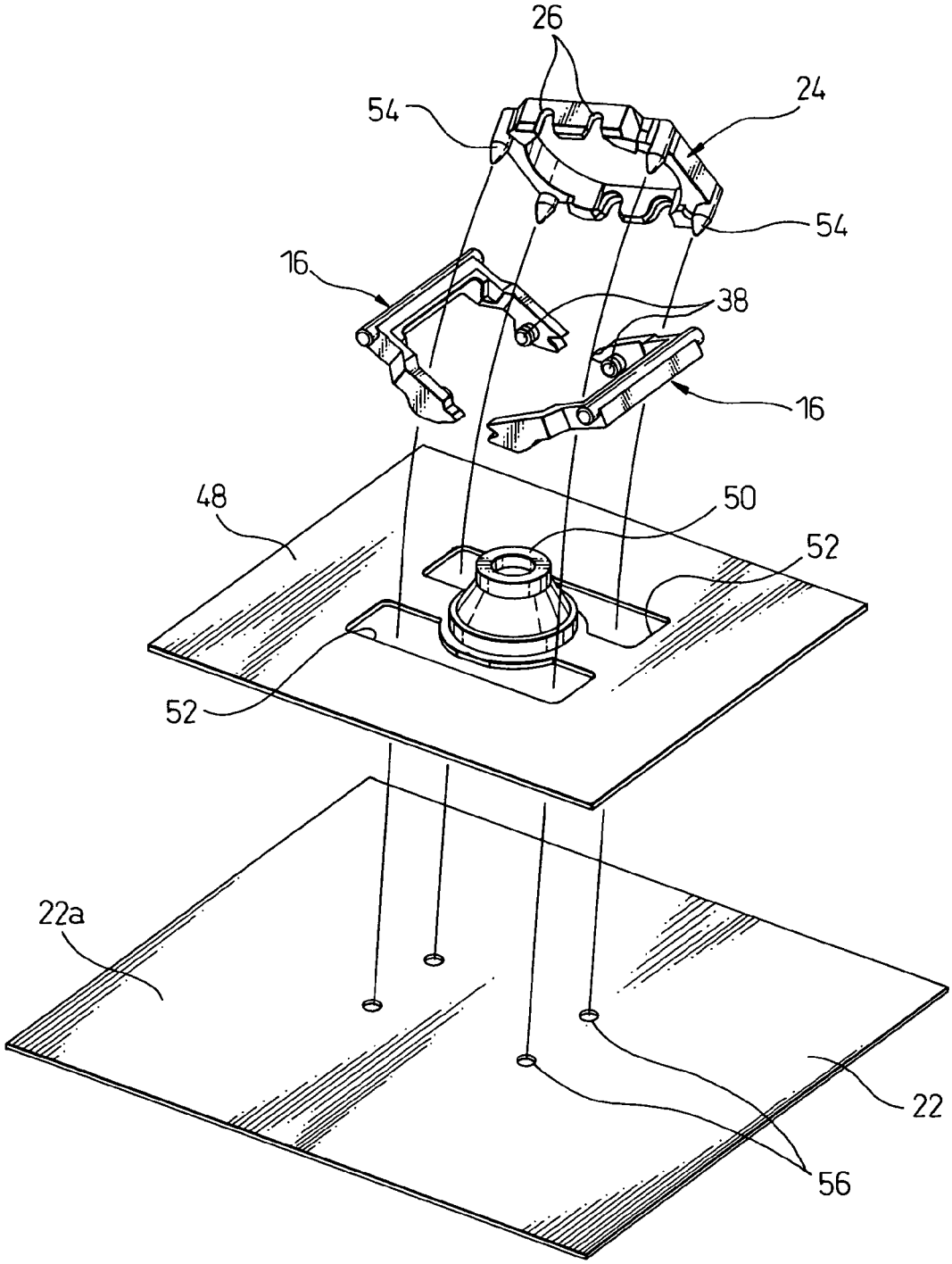
FIG. 8 is an exploded perspective view illustrating the assembling procedure of a part of the key switch of FIG. 1.
Figure 9A:
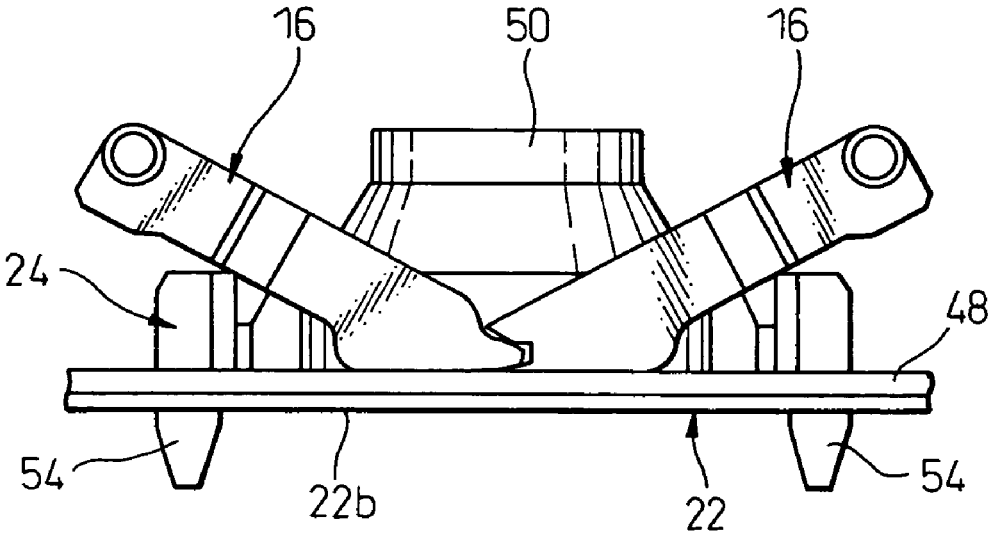
FIG. 9A is a front view diagrammatically showing a part of the key switch of FIG. 1 in a state before fixing a frame member.
Figure 9B:
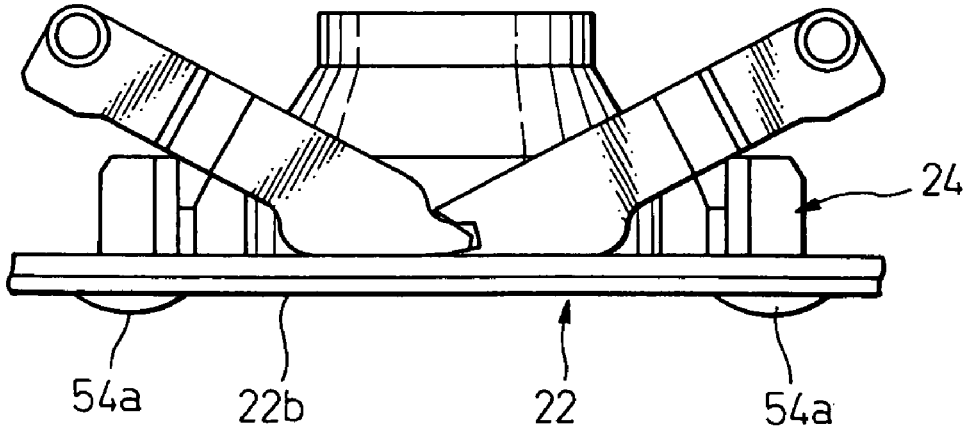
FIG. 9B is a front view diagrammatically showing a part of the key switch of FIG. 1 in a state after fixing the frame member.

In order to fix the frame member 24 to the support plate 22, various methods, such as mechanical fastening, fusing, using adhesives, etc., can be employed. In the illustrated embodiment, in particular, the frame member 24 is provided at four corners thereof with legs 54 projecting outward (downward, in the drawing), and the support plate 22 is provided with reception holes 56 as penetrating holes for respectively receiving the legs 54 (FIG. 8). The frame member 24 is fixed to the support plate 22 by four legs 54 penetrating through the corresponding reception holes 56 (FIG. 9A) and deformed, at respective distal ends thereof, along a lower surface 22*b* (i.e., a surface opposite to the upper surface 22*a*) of the support plate 22 (FIG. 9B). In this connection, in the case where the frame member 24 is made of a resinous material, heat caulking can be employed in which the distal end of each leg 54 is heated for melting and deformation. In the case where the frame member 24 is made of a metal, the distal end of each leg 54 may be pressed for caulking. In either case, when a laterally projecting, deformed part 54*a* is formed at the distal end of the leg 54, the frame member 24 can be simply and stably fixed to the support plate 22, and fixation strength sufficient to retain the frame member 24 on the support plate 22 against an external force acting to pull the key top 14 apart from the base section 12 can be obtained. It is desired that the distal end of each leg 54 has a conical shape as illustrated, so as to facilitate insertion thereof into the corresponding reception hole 56.

Figure 10A:
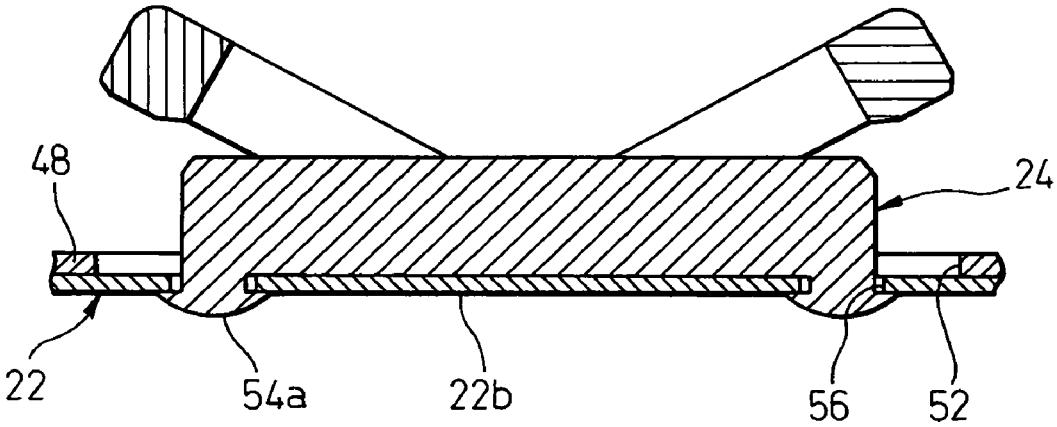
FIG. 10A is a sectional view diagrammatically showing a part of the key switch of FIG. 1 in a state after fixing the frame member.
Figure 10B:
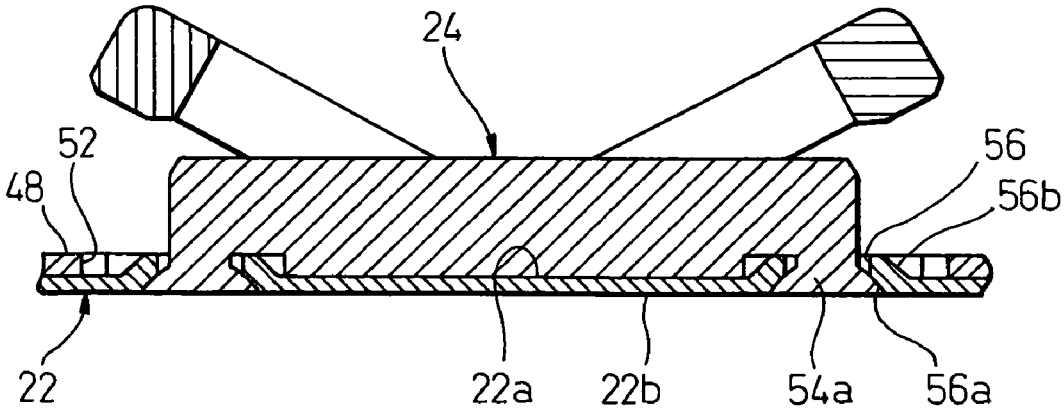
FIG. 10B is a sectional view diagrammatically showing a modification of a part of the key switch of FIG. 1 in a state after fixing the frame member.

In the above configuration, the deformed part 54*a* formed at the distal end of each leg 54 of the frame member 24 tends to slightly project outward from the lower surface 22*b* of the support plate 22 (FIG. 10A). If the projection of the deformed part 54*a* interferes with the height reduction of a keyboard into which the key switch 10 is installed, it is advantageous that the support plate 22 is provided, in the lower surface 22*b* thereof, with a recess 56*a* surrounding each reception hole 56 and receiving the deformed part 54*a* of the corresponding leg 54 of the frame member 24 (FIG. 10B). In this configuration, the deformed part 54*a* of the leg 54 of the frame member 24 can be prevented from projecting from the lower surface 22*b* of the support plate 22, and thus the height reduction of the keyboard into which the key switch 10 is installed can be further facilitated. In either case where the support plate 22 is made of a metal or resinous material, the recess 56*a* for each reception hole 56 can be formed on the lower surface 22*b* by, for example, a drawing process locally performed in a direction from the lower surface 22*b* toward the upper surface 22*a*.

As shown in FIGS. 1 and 10B, annular protrusions 56*b* are formed on the upper surface 22*a* of the support plate 22 by the drawing process.

In the key switch 10 according to the illustrated embodiment, each bearing portion 26 of the frame member 24 is formed as a cutout having an inverted U-shape defined between the frame part 24*a* of the frame member 24 and the upper surface 22*a* of the support plate 22 (FIG. 3). In this configuration, the pivoting axis 46 defined by the pivot axle 38 of each link member 16 (FIG. 2) can be disposed as near as possible to the upper surface 22*a* of the support plate 22, so that the height reduction of the key switch 10 can be further advanced. When assembling the key switch 10, as shown in FIG. 8, the membrane switch sheet 48 is first placed on the upper surface 22*a* of the support plate 22, and thereafter the pair of link members 16 and the frame member 24 can be successively placed, from above, on the support plate 22 so as to be overlapped with each other, so that it is possible to fix the frame member 24 to the support plate 22 while inserting the respective pivot axles 38 into the corresponding bearing portions 26.

Figure 11A:
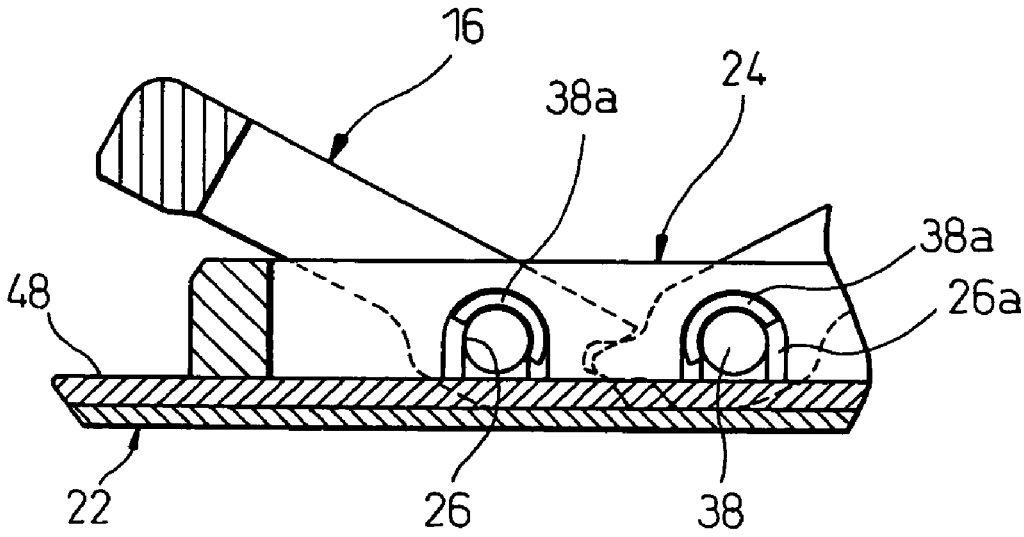
FIG. 11A is a sectional front view diagrammatically showing a part of the key switch of FIG. 1.
Figure 11B:
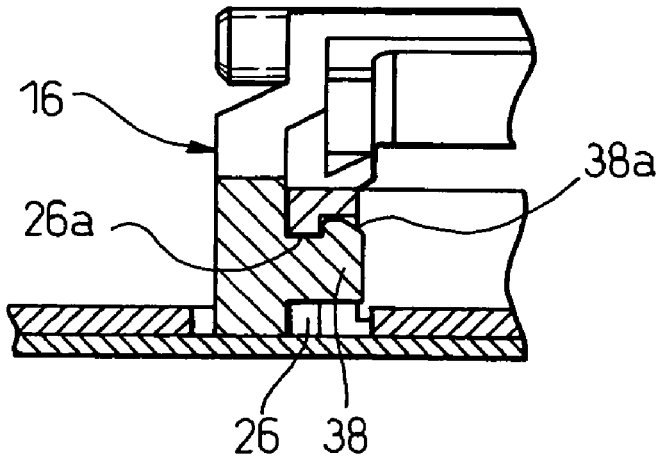
FIG. 11B is a sectional side view diagrammatically showing a part of the key switch of FIG. 1.

In the configuration as described above, as shown in FIGS. 11A and 11B, it is advantageous that each pivot axle 38 of each link member 16 is provided with a hook edge 38*a* adapted to be rotatably hooked on the peripheral edge 26*a* of the inverted U-shaped cutout constituting the bearing portion 26 of the frame member 24. In this arrangement, as shown, e.g., in the drawings, the hook edge 38*a* may be formed to extend over generally half the circumference of the distal end of the link member 16 (FIG. 11A), and a stepped surface may be formed to extend, in U-shape, along the peripheral edge 26*a* of the bearing portion 26 at the inner side of the frame member 24 (FIG. 11B), so that the hook edge 38*a* may be slidably fitted into the stepped surface of the peripheral edge 26*a* of the bearing portion 26. In this configuration, after the key switch 10 is properly assembled, it is possible to stably maintain a condition where the respective pivot axles 38 of each link member 16 is pivotably inserted into the corresponding bearing portions 26 of the frame member 24, against an external force acting to pull the key top 14 apart from the base section 12.

Figure 12A:
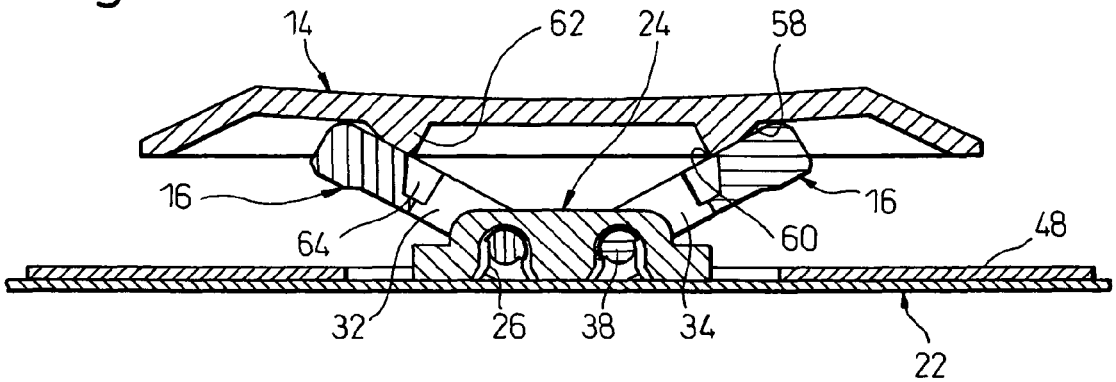
FIG. 12A is an illustration for explaining the function of abutment portions in the key switch of FIG. 1 in a state where the key top is located at the upper limit position of a vertical movement.
Figure 12B:
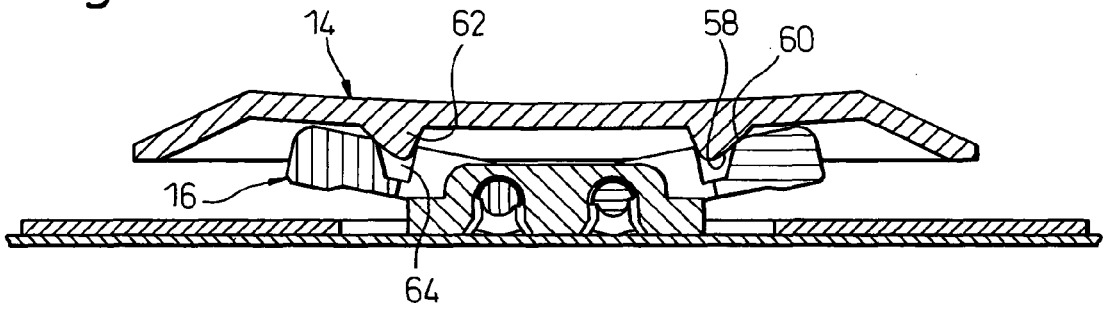
FIG. 12B is an illustration for explaining the function of the abutment portions in the key switch of FIG. 1 in a state where the key top is located at the intermediate position of the vertical movement.
Figure 12C:
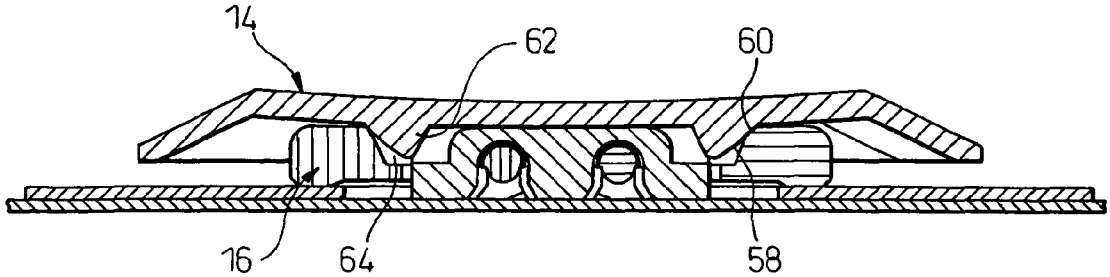
FIG. 12C is an illustration for explaining the function of the abutment portions in the key switch of FIG. 1 in a state where the key top is located at the lower limit position of the vertical movement.

The key switch 10 according to the illustrated embodiment, due to the configuration wherein, during the vertical movement of the key top 14, the slide portion 40 of each link member 16 is moved along the corresponding guide portion 28 of the key top 14, a clearance formed between the slide portion 40 and the guide portion 28 may cause a displacement or fluctuation of the key top in a direction intersecting the vertical movement direction. Therefore, it is advantageous that the key switch 10 is further provided with abutment portions 58, 60 provided on the key top 14 and each of the link members 16, the abutment portions 58, 60 being slidingly abutted to each other during a time when the key top 14 performs the vertical movement and preventing the key top 14 from shifting relative to the pair of link members 16 in a direction intersecting the vertical movement direction (FIGS. 12A to 12C). In the illustrated embodiment, plate-shaped protrusions 62 are formed on the inner surface 14*b* of the key top 14 at locations near the guide portions 28 and nearer the center of the key top in relation to the guide portions so as to project from the inner surface 14*b*. The inclined edge of each protrusion 62 functions as an abutment portion 58 (FIGS. 4, 12*a* to 12C). On the other hand, concavities 64 capable of receiving the corresponding protrusions 62 are formed on each link member 16 at locations near the proximal end of the arms 32, 34 adjacent to the trunk 36. An upper edge of each concavity 64 defining an obtuse included angle functions as an abutment portion 60 (FIG. 5, 12*a* to 12C).

When the key top 14 is located at the upper limit position of the vertical movement, each protrusion 62 is disposed outside the corresponding concavity 64 of the link member 16 so as to ride up on the proximal end region of each arm 32, 34 (FIG. 12A). In this state, due to the engagement of the guide portions 28 with the slide portions 40 under the initial biasing force of the actuating member 50 (FIG. 6) as well as the engagement of the protrusions 62 with the link members 16 (FIG. 12A), the key top 14 is held in a state free of fluctuation. When the key top 14 is depressed from the upper limit position, each link member 16 rotates about the pivot axles 38, and the protrusions 62 enter into the corresponding concavities 64 of the link member 16 while the abutment portions 58, 60 thereof are in sliding contact with each other (FIG. 12B). During this operation, the mating abutment portions 58, 60 are always in sliding contact with each other, and thus it is possible to prevent the key top 14 from being shifted in the direction intersecting the vertical direction, even if a clearance is formed between the guide portion 28 and the slide portion 40. When the key top 14 is further depressed downward and reaches the lower limit position, the protrusions 62 are received in the corresponding concavities 64 while their respective abutment portions 58, 60 are continuously abutted to each other (FIG. 12C). In this state, due to the stable mutual abutment of the mating abutment portions 58, 60, it is also possible to reliably prevent the key top 14 from being shifted in the direction intersecting the vertical direction. Thus, in the configuration as described above, the operability of the keying operation of the key switch 10 is significantly improved.

Figure 13:
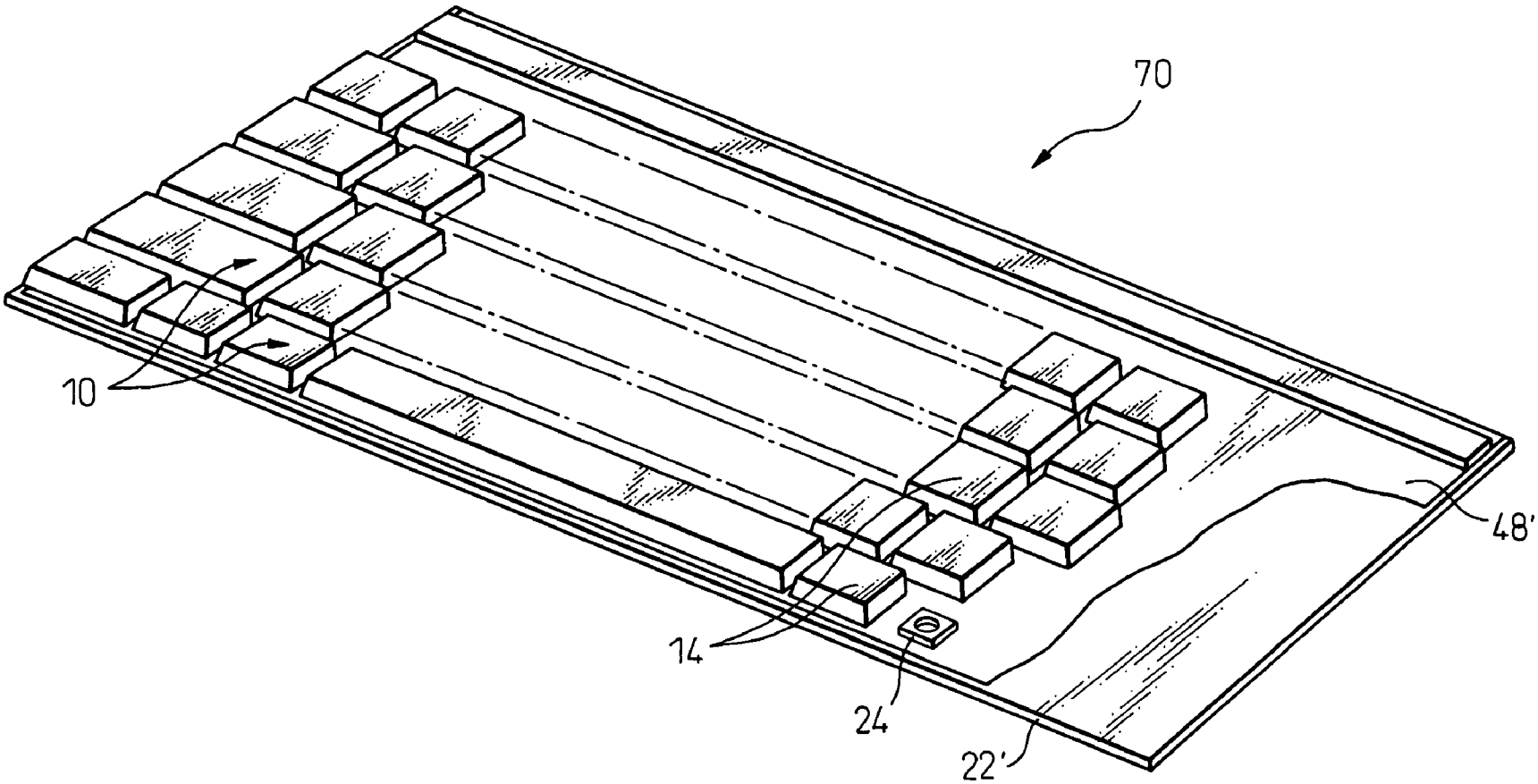
FIG. 13 is a partially cut-away perspective view showing a keyboard according to an embodiment of the present invention.

FIG. 13 diagrammatically shows a keyboard 70 according to an embodiment of the present invention, which includes an array of a plurality of key switches 10 disposed in a predetermined arrangement, each key switch 10 having the configuration of the above-described embodiment. The keyboard 70 has a low-profile structure suitable for use as an input device in a portable electronic apparatus, such as a notebook or palm-top personal computer. In the keyboard 70, the support plate 22 and the membrane switch sheet 48 of the key switch 10 are formed, respectively, as a large-size support plate 22' and a large-size membrane switch sheet 48', both commonly provided for all the key switches 10 incorporated in the keyboard 70. The support plate 22' is provided with frame members 24 fixed at positions respectively corresponding to the key tops 14 of the key switches 10. The keyboard 70 having such configuration is a low-profile keyboard exhibiting excellent operability and structural reliability.

Figure 14:
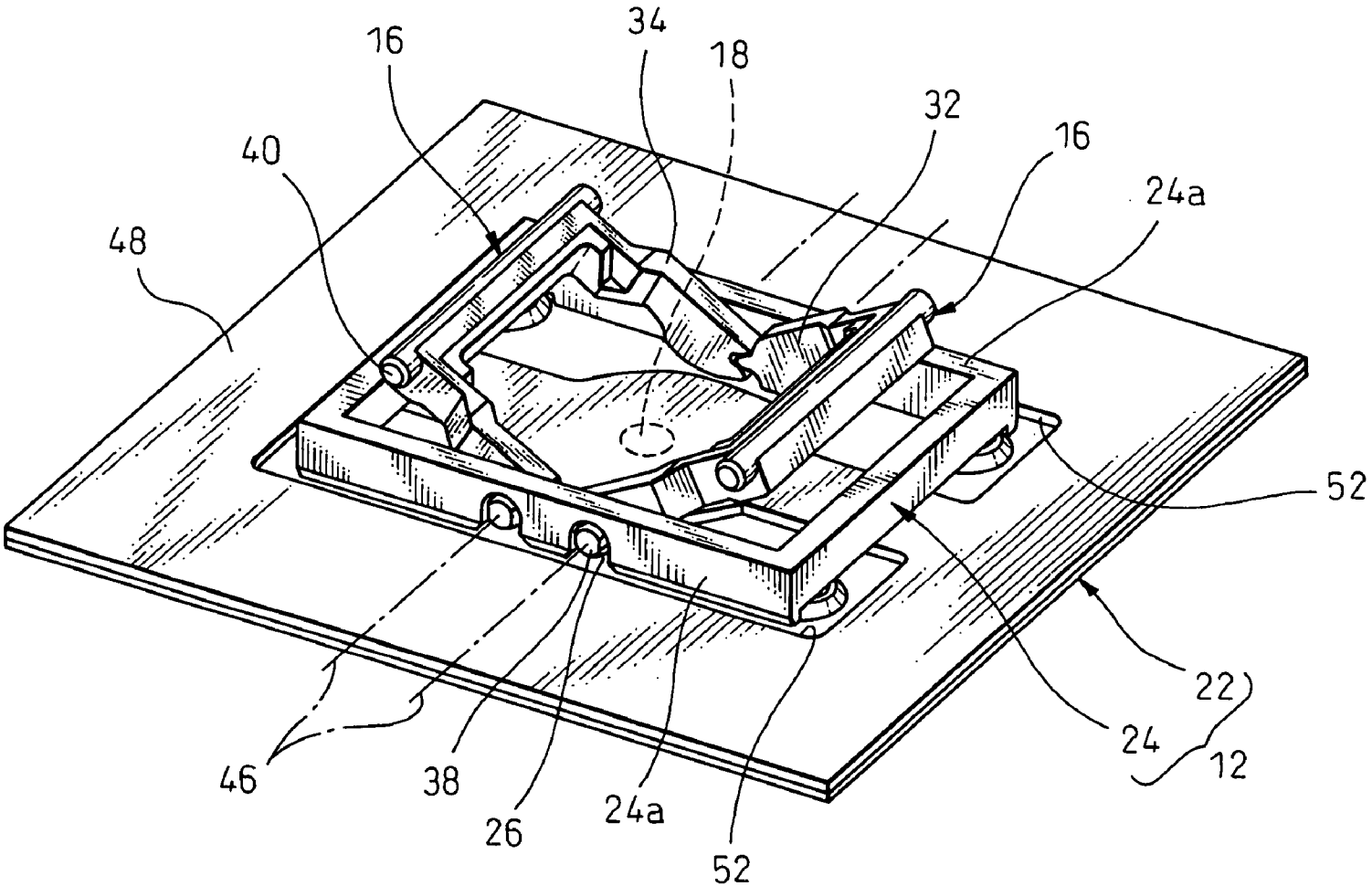
FIG. 14 is a perspective view, corresponding to FIG. 2, showing a part of a key switch as one modification.
Figure 15:
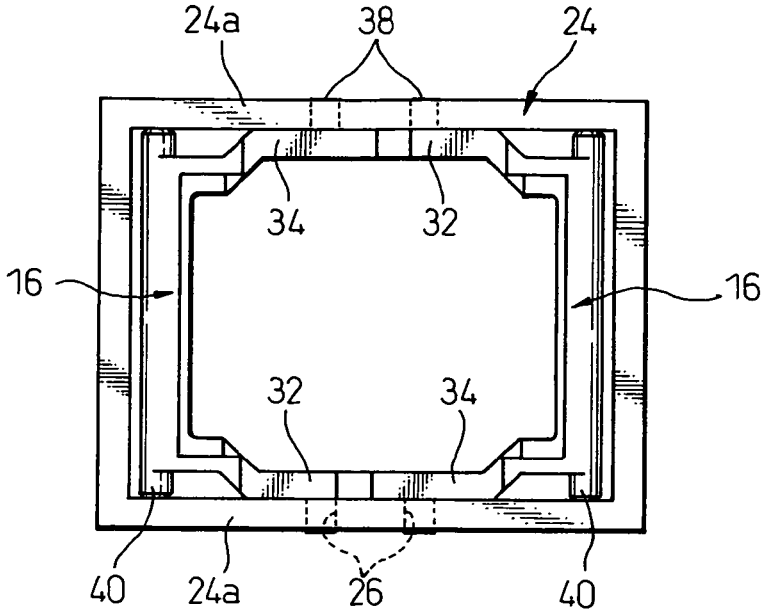
FIG. 15 is a plan view, corresponding to FIG. 7, showing a part of the key switch as the modification.
Figure 16:
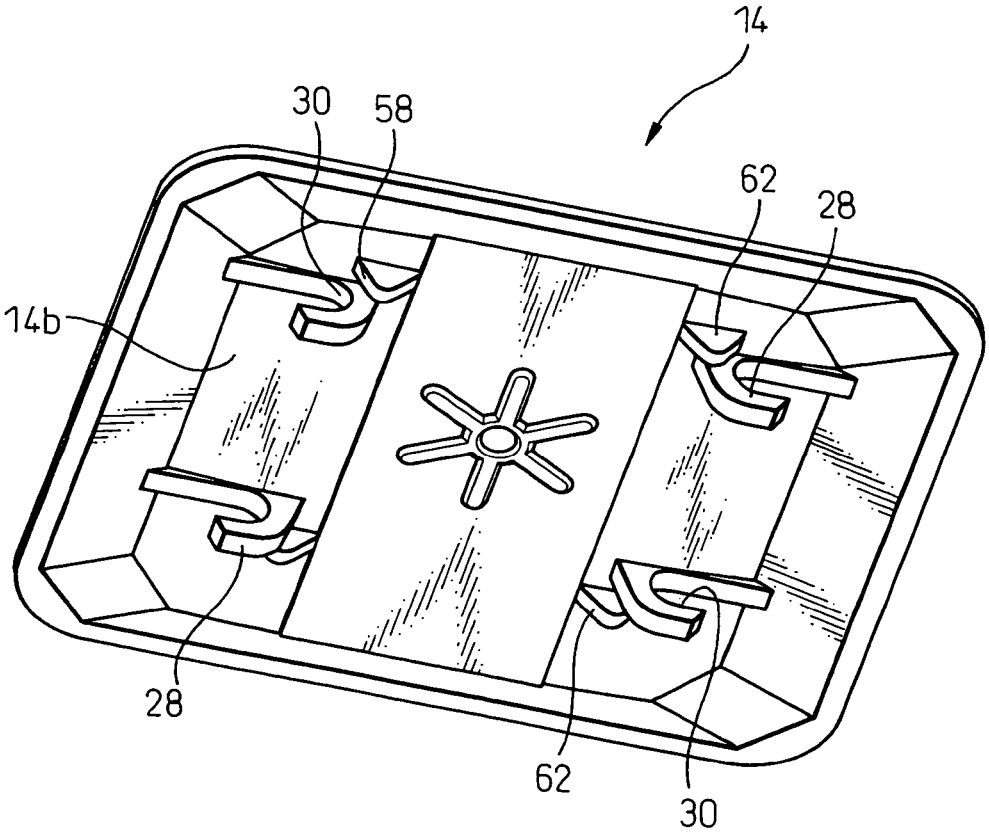
FIG. 16 is a perspective view, corresponding to FIG. 4, showing a key top of the key switch as the modification.

The key switch according to the present invention has been described on the basis of the preferred embodiment, and may include various modifications as follows. For example, as shown in FIGS. 14 and 15, the key switch may be configured such that, when the key top 14 (FIG. 1) is located at the lower limit position of the vertical movement, the frame member 24 is disposed outside the arms 32, 34 of each of the pair of link members 16. In this arrangement, a pair of generally cylindrical pivot axles 38 are provided, in the first end region of the link member 16, to project coaxially with each other from the mutually facing-away outer sides of the arms 32, 34 and parallel to the slide portions 40 in the second end region,. The frame member 24 is a rectangular frame-like component capable of accommodating the pair of link members 16 properly assembled with each other, and is provided, in a pair of frame parts 24*a* constituting two opposing sides of the rectangular profile, with bearing portions 26 for pivotably receiving and supporting the pivot axles 38 of each link member 16. This configuration can ensure the same effects as those obtained by the above-described key switch 10. In this configuration, in particular, the pivot axles 38 of each link member 16 are formed on the outer sides of the arms 32, 34, so that it is possible to make easy an assembling work of the pivot axles 38 relative to the corresponding bearing portions 26 of the frame member 24.

Figure 17:
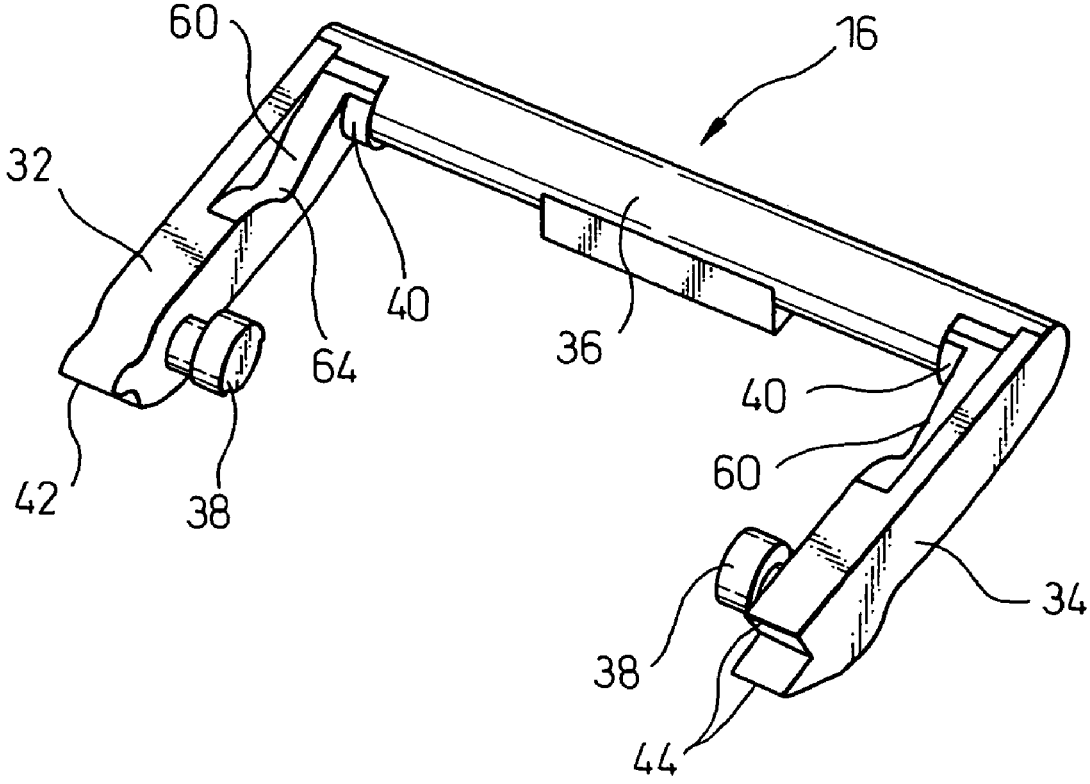
FIG. 17 is a perspective view, corresponding to FIG. 5, showing a link member of the key switch as the modification.

As shown in FIGS. 16 to 18C, the abutment portions 58, 60, for preventing the fluctuation of the key top 14 relative to the pair of link members 16 during the vertical movement of the key top 14, may be configured in such a manner that plate-shaped protrusions 62 are formed on the inner surface 14*b* of the key top 14 at locations near the guide portions 28 and nearer outer periphery of the key top in relation to the guide portions so as to project from the inner surface 14*b*, with the inclined edge of each protrusion 62 functioning as an abutment portion 58 (FIG. 16), and concavities 64 capable of receiving the corresponding protrusions 62 are formed on each link member 16 at locations near the proximal end of the arms 32, 34 adjacent to the trunk 36, with an upper surface of each concavity 64 functioning as an abutment portion 60 (FIG. 17). In this arrangement, in each link member 16, longitudinally opposite end regions of the trunk 36, adjacent to the arms 32, 34, respectively function as the slide portions 40, and the guide portions 28 having the guide grooves 30, for slidably receiving the respective slide portions 40 and guiding them generally in horizontal direction, are formed to protrude on the inner surface 14*a* of the key top 14.

Figure 18A:
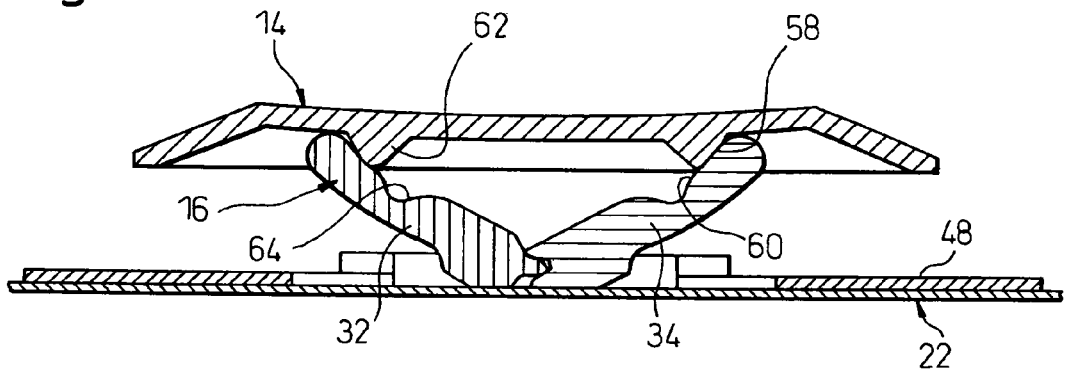
FIG. 18A is an illustration for explaining the function of abutment portions in the key switch as the modification, in a state where the key top is located at the upper limit position of a vertical movement.
Figure 18B:
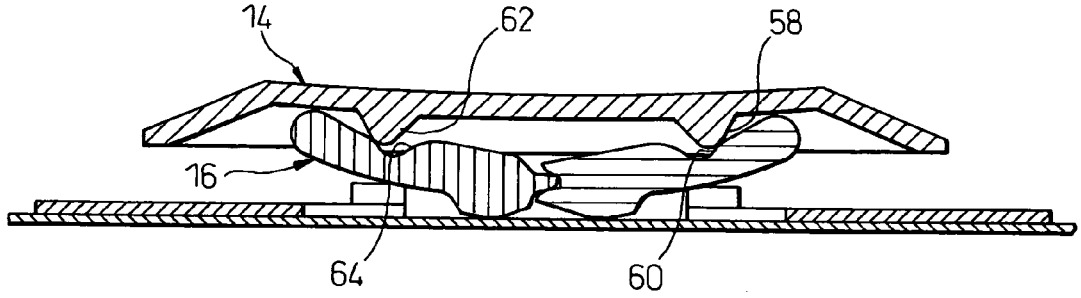
FIG. 18B is an illustration for explaining the function of the abutment portions in the key switch as the modification, in a state where the key top is located at the intermediate position of the vertical movement.
Figure 18C:
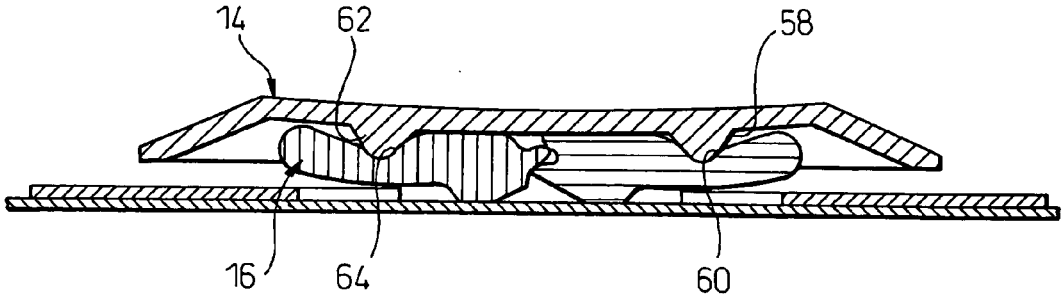
FIG. 18C is an illustration for explaining the function of the abutment portions in the key switch as the modification, in a state where the key top is located at the lower limit position of the vertical movement.

In this configuration, when the key top 14 is located at the upper limit position of the vertical movement, each protrusion 62 is disposed outside the corresponding concavity 64 of the link member 16 so as to ride up on the proximal end region of each arm 32, 34 (FIG. 18A). In this state, due to the engagement of the guide portions 28 with the slide portions 40 under the initial biasing force of the actuating member 50 (FIG. 6) as well as the engagement of the protrusions 62 with the link members 16 (FIG. 18A), the key top 14 is held in a state free of fluctuation. When the key top 14 is depressed from the upper limit position, each link member 16 rotates about the pivot axles 38 (FIG. 17), and the protrusions 62 enter into the corresponding concavities 64 of the link member 16 while the abutment portions 58, 60 thereof are in sliding contact with each other (FIG. 18B). During this operation, the mating abutment portions 58, 60 are always in sliding contact with each other, and thus it is possible to prevent the key top 14 from being shifted in the direction intersecting the vertical direction, even if a clearance is formed between the guide portion 28 and the slide portion 40. When the key top 14 is further depressed down to reach the lower limit position, the protrusions 62 are received in the corresponding concavities 64 while their respective abutment portions 58, 60 are continuously abutted against each other (FIG. 18C). In this state, due to the stable mutual abutment of the mating abutment portions 58, 60, it is also possible to reliably prevent the key top 14 from being shifted in the direction intersecting the vertical direction.

Figure 19:
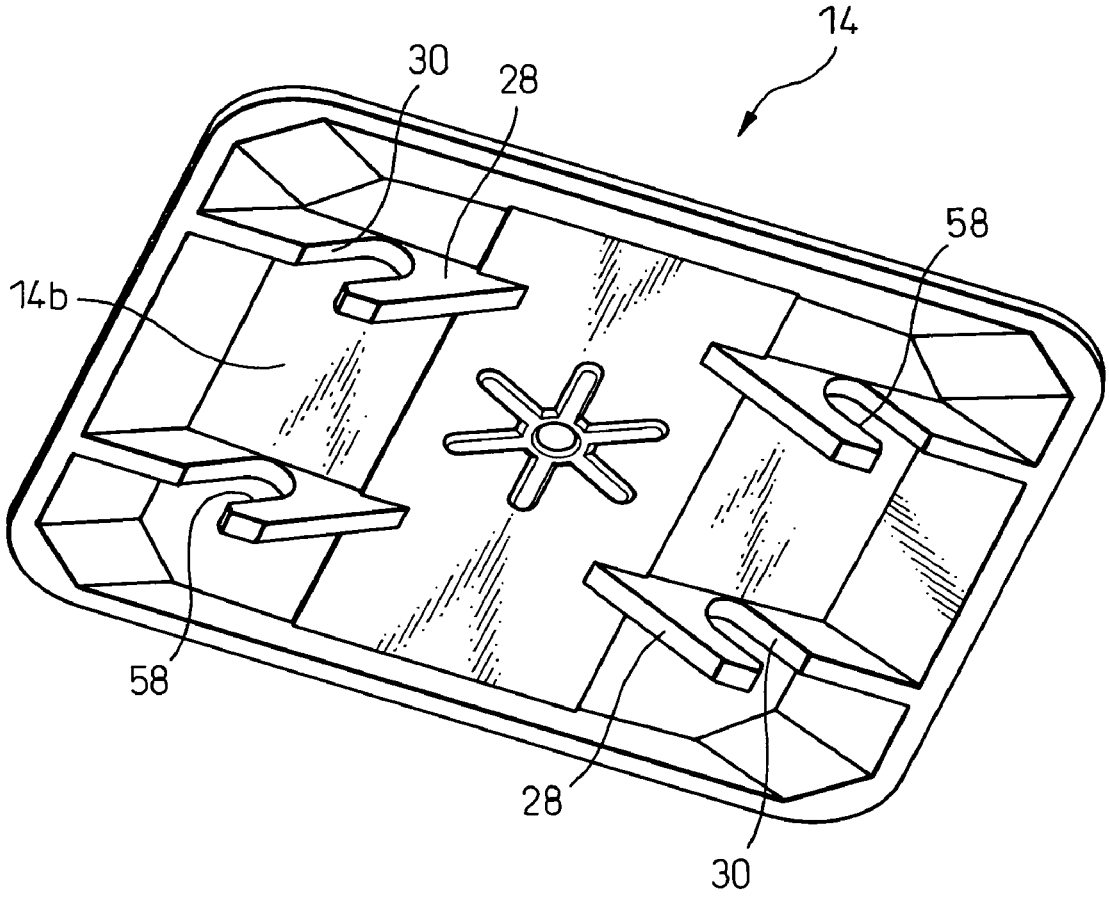
FIG. 19 is a perspective view, corresponding to FIG. 4, showing a key top of a key switch as another modification.
Figure 20:
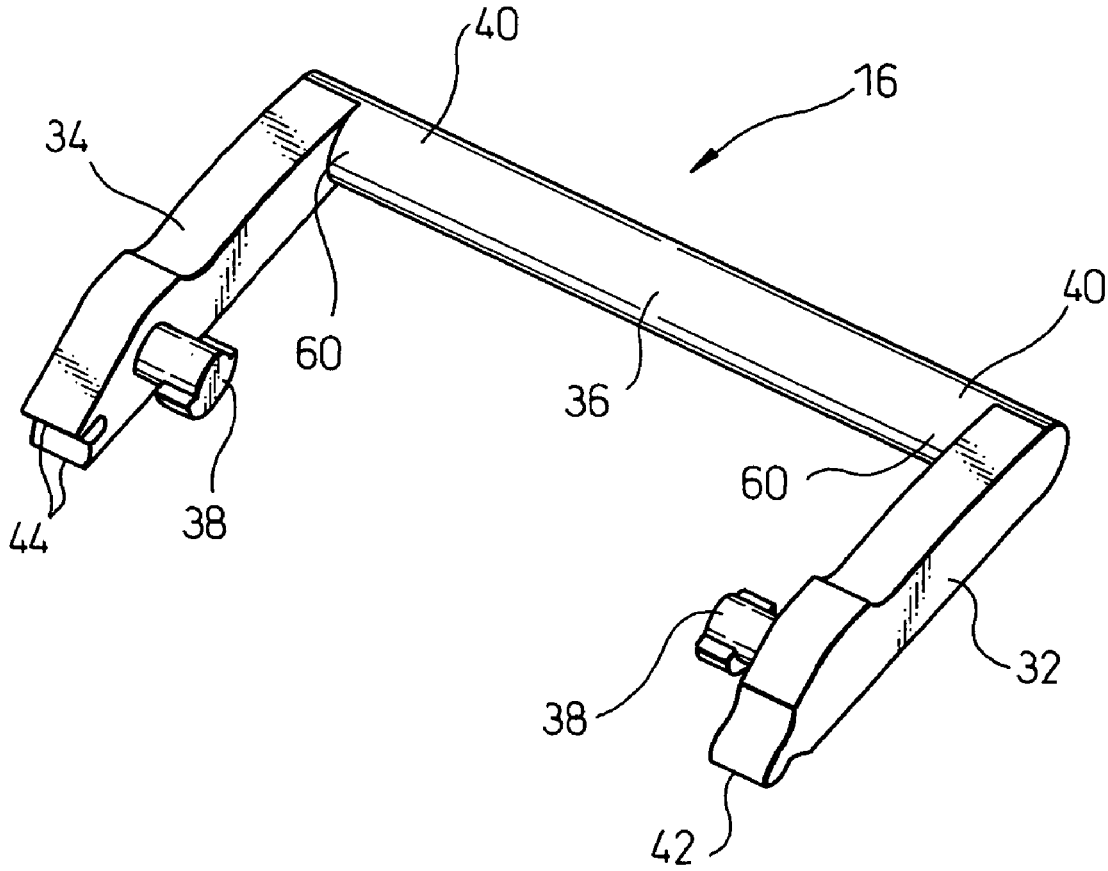
FIG. 20 is a perspective view, corresponding to FIG. 5, showing a link member of the key switch as the other modification.

As shown in FIGS. 19 to 21, the abutment portions 58, 60, for preventing the fluctuation of the key top 14 relative to the pair of link members 16 during the vertical movement of the key top 14, may also be configured in such a manner that the guide grooves 30 are formed in the respective guide portions 28 of the key top 14 so as to extend from the inner surface 14*b* toward the outer periphery in an inclined manner, with the inclined edge of each guide groove 30 functioning as an abutment portion 58 (FIG. 19), and each of the outer circumferential surfaces of the respective slide portions 40, defined at the longitudinally opposite end regions of the trunk 36 adjacent to the arms 32, 34 of each link member, are provided to function as an abutment portion 60 (FIG. 20).

Figure 21A:
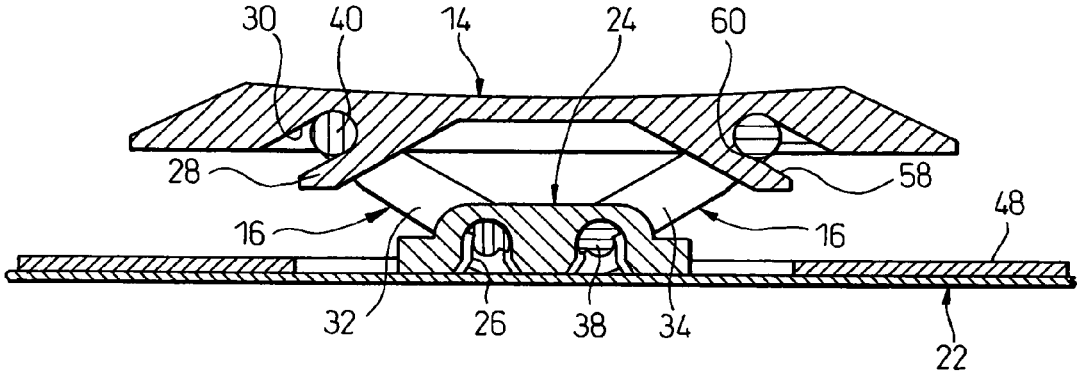
FIG. 21A is an illustration explaining the function of abutment portions in the key switch as the other modification, in a state where the key top is located at the upper limit position of a vertical movement.
Figure 21B:
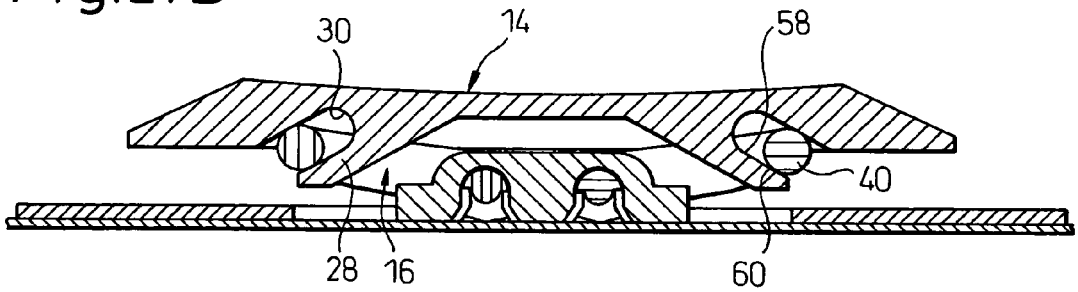
FIG. 21B is an illustration explaining the function of the abutment portions in the key switch as the other modification, in a state where the key top is located at the intermediate position of the vertical movement.
Figure 21C:
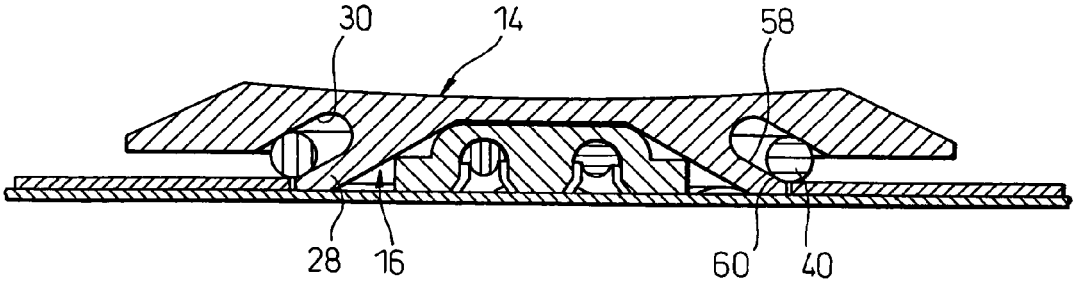
FIG. 21C is an illustration explaining the function of the abutment portions in the key switch as the modification, in a state where the key top is located at the lower limit position of the vertical movement.

In this configuration, when the key top 14 is located at the upper limit position of the vertical movement, the guide groove 30 of each guide portion 28 is engaged at its bottom with the corresponding slide portion 40 of the link member 16 (FIG. 21A). In this state, due to the engagement of the abutment portions 58 of the guide grooves 30 with the abutment portions 60 of the slide portions 40 under the initial biasing force of the actuating member 50, the key top 14 is held in a state free of fluctuation. When the key top 14 is depressed from the upper limit position, each link member 16 rotates about the pivot axles 38 (FIG. 20), and the slide portions 40 of the link member 16 are moved along the corresponding guide grooves 30 of the respective guide portions 28 while the abutment portions 58, 60 thereof are in sliding contact with each other (FIG. 21B). During this operation, the mating abutment portions 58, 60 are always in sliding contact with each other, and thus it is possible to prevent the key top 14 from being shifted in the direction intersecting the vertical direction, even if a clearance is formed between the guide portion 28 and the slide portion 40 (in particular, its bottom). When the key top 14 is further depressed down to reach the lower limit position, the slide portions 40 of the link member are disposed at the lower ends of the respective guide grooves 30 while their respective abutment portions 58, 60 are continuously abutted to each other (FIG. 21C). In this state, due to the stable mutual abutment of the mating abutment portions 58, 60, it is also possible to reliably prevent the key top 14 from being shifted in the direction intersecting the vertical direction.

While the invention has been described with reference to specific preferred embodiments, it will be understood by those skilled in the art that various changes and modifications may be made thereto without departing from the scope of the following claims.

The invention claimed is:

1. A key switch comprising:

a base section;

a key top disposed above said base section;

a pair of link members interlocked with each other to support and direct said key top in a vertical direction relative to said base section; and a switching mechanism capable of opening and closing a contact section of an electronic circuit in accordance with a vertical movement of said key top;

wherein each of said pair of link members is provided, at a first end region thereof, with a toothed portion meshable with a toothed portion of another link member in a gearing manner and a pivot axle pivotably joined to said base section and, at a second end region of each link member, with a slide portion slidably engaged with said key top;

wherein said switching mechanism includes a membrane switch sheet carrying said contact section at a position beneath said key top;

wherein said base section comprises a support plate provided with an upper surface, said membrane switch sheet being placed on said upper surface, and a frame member formed separately from said support plate and fixedly placed on said upper surface of said support plate, said frame member being provided with a bearing portion pivotably receiving and supporting said pivot axle of each of said pair of link members;

wherein said first end region of each of said pair of link members is disposed on an exterior lateral side of said frame member; and wherein said bearing portion of said frame member is formed as an open-ended cutout defined between said frame member and said upper surface of said support plate such that a portion of the frame member defining the open end of the cutout is in contact with the upper surface of the support plate.

2. A key switch as set forth in claim 1, wherein said pivot axle of each of said pair of link members includes a hook edge adapted to be rotatably hooked on an edge of said bearing portion of said frame member.

3. A key switch as set forth in claim 1, wherein said membrane switch sheet is provided with a through-hole at an area at least corresponding to said bearing portion of said frame member; and wherein each of said pair of link members extends, at said one end region including said pivot axle, through said through-hole of said membrane switch sheet and placed on said upper surface of said support plate.

4. A key switch as set forth in claim 3, wherein said frame member extends through said through-hole of said membrane switch sheet and is fixed to said support plate.

5. A key switch as set forth in claim 1, wherein said frame member is provided with a leg projecting outward; wherein said support plate is provided with a reception hole for receiving said leg; and wherein said frame member is fixed to said support plate by said leg penetrating through said reception hole and deformed along a lower surface of said support plate.

6. A key switch as set forth in claim 5, wherein said support plate is provided, in said lower surface thereof, with a recess surrounding said reception hole, said recess receiving a deformed part of said leg of said frame member.

7. A key switch as set forth in claim 1, wherein, when said key top is located at a lower limit position of said vertical movement, said pair of link members are disposed in their entirety along said lateral side of said frame member.

8. A key switch as set forth in claim 7, wherein each of said pair of link members includes a pair of arms extending in a direction identical to each other; and wherein, when said key top is located at said lower limit position, said frame member is disposed inside said pair of arms of each of said pair of link members.

9. A key switch as set forth in claim 7, wherein each of said pair of link members includes a pair of arms extending in a direction identical to each other; and wherein, when said key top is located at said lower limit position, said frame member is disposed outside said pair of arms of each of said pair of link members.

10. A key switch as set forth in claim 1, further comprising abutment portions provided on said key top and each of said pair of link members, said abutment portions being slidingly abutted to each other during a time when said key top performs said vertical movement and preventing said key top from shifting relative to said pair of link members in a direction intersecting said vertical direction.

11. A keyboard comprising an array of a plurality of key switches, each key switch being defined in claim 1.

12. A key switch comprising:

a base section;

a key top disposed above said base section;

a pair of link members interlocked with each other to support and direct said key top in a vertical direction relative to said base section; and a switching mechanism capable of opening and closing a contact section of an electronic circuit in accordance with a vertical movement of said key top;

wherein each of said pair of link members is provided, at one end region thereof, with a toothed portion meshable with a toothed portion of another link member in a gearing manner and a pivot axle pivotably joined to said base section and, at another end region of each link member, with a slide portion slidably engaged with said key top;

wherein said base section comprises a support plate provided with an upper surface adjacent to said switching mechanism, and a frame member fixedly attached to said upper surface of said support plate, said frame member being provided with a bearing portion pivotably receiving and supporting said pivot axle of each of said pair of link members;

wherein said one end region of each of said pair of link members is disposed on a lateral side of said frame member and closely to said upper surface of said support;

wherein said bearing portion of said frame member is formed as a cutout defined between said frame member and said upper surface of said support plate; and wherein said pivot axle of each of said pair of link members includes a hook edge adapted to be rotatably hooked on an edge of said bearing portion of said frame member.

13. A key switch comprising:

a base section;

a key top disposed above said base section;

a pair of link members interlocked with each other to support and direct said key top in a vertical direction relative to said base section; and a switching mechanism capable of opening and closing a contact section of an electronic circuit in accordance with a vertical movement of said key top;

wherein each of said pair of link members is provided, at one end region thereof, with a toothed portion meshable with a toothed portion of another link member in a gearing manner and a pivot axle pivotably joined to said base section and, at another end region of each link member, with a slide portion slidably engaged with said key top;

wherein said base section comprises a support plate provided with an upper surface adjacent to said switching mechanism, and a frame member fixedly attached to said upper surface of said support plate, said frame member being provided with a bearing portion pivotably receiving and supporting said pivot axle of each of said pair of link members;

wherein said one end region of each of said pair of link members is disposed on a lateral side of said frame member and closely to said upper surface of said support; AND wherein said switching mechanism includes a membrane switch sheet disposed on said upper surface of said support plate and carrying said contact section at a position beneath said key top; wherein said membrane switch sheet is provided with a through-hole at an area at least corresponding to said bearing portion of said frame member; and wherein each of said pair of link members extends, at said one end region including said pivot axle, through said through-hole of said membrane switch sheet and placed on said upper surface of said support plate.

14. A key switch as set forth in claim 13, wherein said frame member extends through said through-hole of said membrane switch sheet and is fixed to said support plate.

* * * * *